US009014838B2

(12) United States Patent
Muto

(10) Patent No.: US 9,014,838 B2
(45) Date of Patent: Apr. 21, 2015

(54) SEWING MACHINE, APPARATUS, AND NON-TRANSITORY COMPUTER-READABLE MEDIUM STORING COMPUTER-READABLE INSTRUCTIONS

(71) Applicant: Yukiyoshi Muto, Nagoya (JP)

(72) Inventor: Yukiyoshi Muto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 14/029,114

(22) Filed: Sep. 17, 2013

(65) Prior Publication Data

US 2014/0109815 A1 Apr. 24, 2014

(30) Foreign Application Priority Data

Oct. 19, 2012 (JP) ..... 2012-231461

(51) Int. Cl.

| | |
|---|---|
| ***D05C 7/08*** | (2006.01) |
| ***D05B 19/08*** | (2006.01) |
| ***D05C 7/02*** | (2006.01) |
| *D05B 19/10* | (2006.01) |

(52) U.S. Cl.

CPC *D05B 19/08* (2013.01); *D05C 7/08* (2013.01); *D05B 19/10* (2013.01); *D05C 7/02* (2013.01); *D05D 2303/18* (2013.01)

(58) Field of Classification Search

CPC ..... D05B 19/10; D05B 19/14; D05B 19/04; D05B 19/12; D05B 19/08; G05B 2219/2626; G05B 2219/45195; D05C 7/02; D05C 7/08

USPC ..... 700/136–138; 112/475.01, 475.15, 112/475.18, 470.01

See application file for complete search history.

(56) References Cited

U.S. PATENT DOCUMENTS

| | | | | |
|---|---|---|---|---|
| 4,848,253 | A * | 7/1989 | Tajima | 112/99 |
| 5,481,993 | A * | 1/1996 | Kurihara | 112/475.01 |
| 6,298,276 | B1 | 10/2001 | Iida | |
| 7,293,512 | B2 * | 11/2007 | Tajima et al. | 112/106 |
| 7,460,925 | B2 * | 12/2008 | Noguchi | 700/138 |
| 7,934,461 | B2 * | 5/2011 | Tajima | 112/475.01 |
| 2007/0199490 | A1 * | 8/2007 | Suzuki | 112/98 |
| 2008/0087206 | A1 * | 4/2008 | Murase | 112/106 |
| 2010/0313806 | A1 * | 12/2010 | Konig et al. | 112/475.01 |
| 2012/0260838 | A1 * | 10/2012 | Matsuhiro | 112/475.18 |
| 2013/0233217 | A1 | 9/2013 | Shimizu et al. | |
| 2013/0233218 | A1 | 9/2013 | Nishimura et al. | |
| 2013/0233219 | A1 | 9/2013 | Nakamura et al. | |
| 2013/0233220 | A1 | 9/2013 | Nomura et al. | |
| 2013/0233221 | A1 | 9/2013 | Abe et al. | |
| 2013/0233222 | A1 | 9/2013 | Nishimura et al. | |
| 2014/0109815 | A1 * | 4/2014 | Muto | 112/470.04 |

FOREIGN PATENT DOCUMENTS

| | | |
|---|---|---|
| JP | A-11-239685 | 9/1999 |
| JP | A-2008-036038 | 2/2008 |

* cited by examiner

*Primary Examiner* — Danny Worrell
(74) *Attorney, Agent, or Firm* — Oliff PLC

(57) ABSTRACT

A sewing machine includes a sewing portion, a processor, and a memory. The sewing portion is configured to perform sewing on a work cloth. The memory is configured to store computer-readable instructions. The computer-readable instructions cause the processor to perform processes that include specifying an inside position that is a position inside a hole in at least one sequin that has been disposed on the work cloth in advance, creating sewing data based on the inside position that has been specified, and causing the sewing portion to sew the at least one sequin onto the work cloth, based on the sewing data that has been created. The sewing data includes at least needle drop point data and is data for sewing the at least one sequin onto the work cloth. The needle drop point data indicates a point where a sewing needle is to pierce the work cloth.

17 Claims, 26 Drawing Sheets

SEWING MACHINE, APPARATUS, AND NON-TRANSITORY COMPUTER-READABLE MEDIUM STORING COMPUTER-READABLE INSTRUCTIONS

CROSS-REFERENCE TO RELATED APPLICATION

This application claims priority to Japanese Patent Application No. 2012-231461 filed Oct. 19, 2012, the content of which is hereby incorporated herein by reference.

BACKGROUND

The present disclosure relates to a sewing machine that processes sewing data for sewing a sequin onto a work cloth, as well as to an apparatus and to a non-transitory computer-readable medium that stores computer-readable instructions.

A sewing machine is known that is capable of sewing a sequin onto a work cloth.

For example a multi-needle sewing machine is known that is capable of sewing a sequin onto a work cloth. The known multi-needle sewing machine includes a head that has a plurality of needle bars. The head is provided with a sequin supply device. In conjunction with the operating of one of the plurality of the needle bars, sequins are continuously supplied from the sequin supply device to a work cloth, and the sequins are sewn onto the work cloth.

SUMMARY

However, the sewing machine that is described above perform sewing in accordance with sewing data that are created in advance, while using a dedicated supply device to arrange the sequins on the work cloth. It is not possible for the sewing machine to sew the sequins onto the work cloth in accordance with an arrangement of the sequins after a user has arranged the sequins at arbitrary positions on the work cloth and confirmed the arrangement of the sequins.

Embodiments of the broad principles derived herein provide a sewing machine that enables sequins to be sewn in accordance with an arrangement of the sequins on the work cloth that a user has confirmed, and also provide an apparatus and a non-transitory computer-readable medium that stores computer-readable instructions.

Embodiments provide a sewing machine that includes a sewing portion, a processor, and a memory. The sewing portion is configured to perform sewing on a work cloth. The memory is configured to store computer-readable instructions. The computer-readable instructions cause the processor to perform a process that includes specifying an inside position that is a position inside a hole in at least one sequin that has been disposed on the work cloth in advance. The computer-readable instructions further cause the processor to perform a process that includes creating sewing data based on the inside position that has been specified. The sewing data includes at least needle drop point data and is data for sewing the at least one sequin onto the work cloth. The needle drop point data indicates a point where a sewing needle is to pierce the work cloth. The computer-readable instructions further cause the processor to perform a process that includes causing the sewing portion to sew the at least one sequin onto the work cloth, based on the sewing data that has been created.

Embodiments also provide an apparatus that includes a processor and a memory. The memory is configured to store computer-readable instructions. The computer-readable instructions cause the processor to perform processes that include specifying an inside position that is a position inside a hole in at least one sequin that has been disposed on a work cloth in advance, and creating sewing data based on the inside position that has been specified. The sewing data includes at least needle drop point data and is data for sewing the at least one sequin onto the work cloth. The needle drop point data indicates a point where a sewing needle is to pierce the work cloth.

Embodiments further provide a non-transitory computer-readable medium storing computer-readable instructions that, when executed by a processor of an apparatus, instruct the processor to perform processes that include specifying an inside position that is a position inside a hole in at least one sequin that has been disposed on a work cloth in advance, and creating sewing data based on the inside position that has been specified. The sewing data includes at least needle drop point data and is data for sewing the at least one sequin onto the work cloth. The needle drop point data indicates a point where a sewing needle is to pierce the work cloth.

BRIEF DESCRIPTION OF THE DRAWINGS

Embodiments will be described below in detail with reference to the accompanying drawings in which.

DETAILED DESCRIPTION

Hereinafter, embodiments will be explained with reference to the drawings.

Configuration of the Sewing Machine 1 in a First Embodiment

Figure 1:
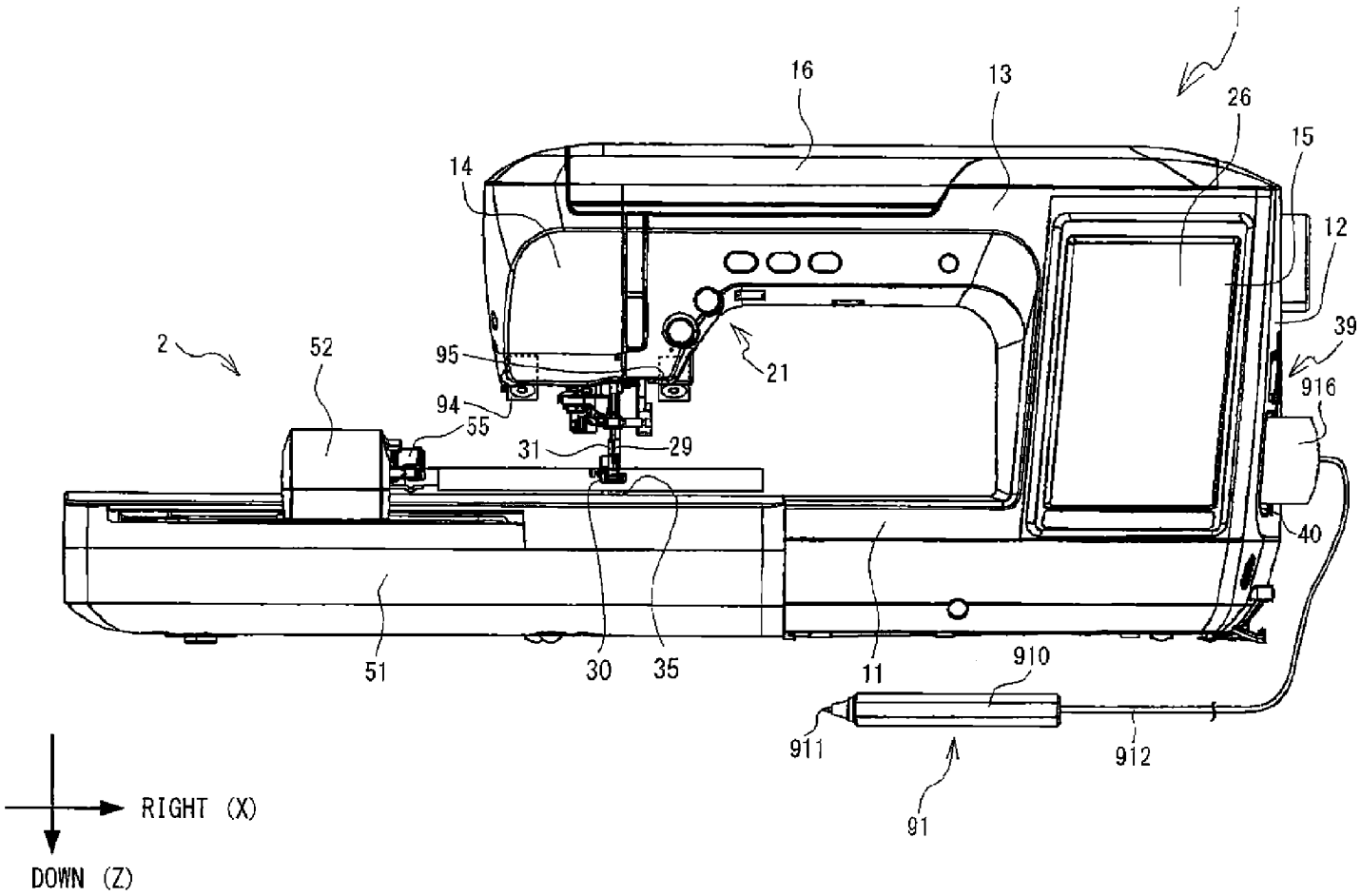
FIG. 1 is a front view of a sewing machine in a first embodiment, on which an embroidery unit has been mounted.

The physical configuration of the sewing machine 1 according to a first embodiment will be explained with reference to FIG. 1. The sewing machine 1 includes a bed 11, a pillar 12, an arm 3, and a head 14. The bed 11 is the base portion of the sewing machine 1. The bed 11 has a flat surface on which an embroidery unit 2 can be placed. The pillar 12 extends from the bed 11. The arm 13 extends from the pillar 12 and is opposite to the bed 11. The head 14 is provided on the end of the arm 13.

The direction in which the pillar 12 extends from the bed 11 is defined as the upward direction, and the opposite direction from the upward direction is defined as the downward direction. The direction in which the arm 13 extends from the pillar 12 is defined as the leftward direction, and the opposite direction from the leftward direction is defined as the rightward direction. A direction that is orthogonal both to the left-right direction and to the up-down direction is defined as the front-rear direction.

A needle bar 29 and a presser bar 31 extend downward from the lower edge of the head 14. A sewing needle may be attached to the lower end of the needle bar 29. A presser foot 30 may be attached to the lower end of the presser bar 31. The presser foot 30 may press a work cloth that is not shown in the drawings. A needle bar mechanism is provided in the head 14. The needle bar mechanism may move the needle bar 29 up and down. A sewing machine motor 79 (refer to FIG. 6) may drive the needle bar mechanism.

The sewing machine 1 can be used in a state in which the embroidery unit 2 has been mounted on the sewing machine 1. The embroidery unit 2 can be mounted on and removed from the bed 11 of the sewing machine 1. The embroidery unit 2 includes a body 51 and a carriage 52. When the embroidery unit 2 is mounted on the sewing machine 1, the embroidery unit 2 and the sewing machine 1 are electrically connected.

The carriage 52 is provided on the top side of the body 51. The carriage 52 has a three-dimensional rectangular shape whose long dimension extends in the front-rear direction. The carriage 52 includes a frame holder 55, a Y axis moving mechanism, and a Y axis motor 87 (refer to FIG. 6). The frame holder 55 is a holder on which an embroidery frame 35 may be removably mounted. The frame holder 55 is provided on the right side face of the carriage 52. The embroidery frame 35 includes an inner frame and an outer frame. As shown in detail in FIG. 9, the embroidery frame 35 may hold a work cloth 100 by clamping the work cloth 100 between an inner frame 112 and an outer frame 111. The work cloth 100 that is held by the embroidery frame 35 is disposed above the top side of the bed 11 and below the needle bar 29 and the presser foot 30. The Y axis moving mechanism may move the frame holder 55 frontward and rearward (along a Y axis). The embroidery frame 35 that holds the work cloth 100 may be moved frontward and rearward by the frontward and rearward moving of the frame holder 55. The Y axis motor 87 may drive the Y axis moving mechanism. A CPU 61 (refer to FIG. 6) of the sewing machine 1 may control the Y axis motor 87.

An X axis moving mechanism and an X axis motor 86 (refer to FIG. 6) are provided in the interior of the body 51. The X axis moving mechanism and the X axis motor 86 may move the carriage 52 leftward and rightward (along an X axis). The left-right movement of the carriage 52 causes the embroidery frame 35 to move the work cloth 100 leftward and rightward. The X axis motor 86 may drive the X axis moving mechanism. The CPU 61 of the sewing machine 1 may control the X axis motor 86.

A cover 16 that can be opened and closed is provided in the upper part of the arm 13. A thread spool is accommodated under the cover 16, that is, generally in the central portion inside the arm 13. A thread that is wound around the thread spool is supplied from the thread spool to the sewing needle that is mounted on the needle bar 29, by way of a thread guide portion that is provided in the head 14. A plurality of operation switches 21 are provided in the lower portion of the front face of the arm 13. The plurality of the operation switches 21 include a start/stop switch.

An LCD 15 is provided on the front face of the pillar 12. A screen that includes various types of items, such as commands, illustrations, setting values, messages, and the like, may be displayed on the LCD 15. A touch panel 26 is provided on the front face of the LCD 15. When a user uses a finger or a special touch pen to press on the touch panel 26, the sewing machine 1 recognizes the item that corresponds to the pressed position that is detected by the touch panel 26 as having been selected. By pressing on the touch panel 26, the user is able to select an embroidery pattern to be sewn, a command to be executed, and the like.

The sewing machine 1 includes receivers 94, 95. The receiver 94 and the receiver 95 have identical structures. The receivers 94, 95 are positioned above the embroidery frame 35 and may detect ultrasonic waves that are transmitted from an ultrasonic pen 91. The receiver 94 is provided in the left rear part of the bottom face of the head 14. The receiver 95 is provided in the right rear part of the bottom face of the head 14. The receivers 94, 95 are separated from one another by the length of the head 14 in the left-right direction.

An external connector 39 and a pen connector 40 are provided on the right side face of the pillar 12. The external connector 39 is configured such that an external storage device (not shown in the drawings) such as a memory card or the like can be connected to the external connector 39. The sewing machine 1 may acquire data for embroidery patterns, as well as various types of programs, from the external storage device that is electrically connected to the external connector 39. The pen connector 40 may be electrically connected to a pen connector 916. The pen connector 916 is joined to a cable 912 that extends from the ultrasonic pen 91, which will be described below. The sewing machine 1 may supply electric power to the ultrasonic pen 91 via the pen connector 40, the pen connector 916, and the cable 912.

The ultrasonic pen 91 will be explained. The ultrasonic pen 91 includes a pen body 910 and a pen tip 911. The ultrasonic pen 91 has a shape that the user can grip. Specifically, the shape of the pen body 910 is a rod shape with a polygonal cross section. The pen tip 911 is provided on one end of the pen body 910 in the longitudinal direction of the pen body 910. The tip of the pen tip 911 is pointed. The pen tip 911 is in a projecting position, in which the pen tip 911 projects slightly to the outside of the pen body 910 in the longitudinal direction. When a force is not acting on the pen tip 911, that is, when the pen tip 911 is in the projecting position, the ultrasonic pen 91 does not transmit ultrasonic waves. By pressing the pen tip 911 against a desired position on the work cloth 100, the user can cause a force to act on the pen tip 911. In a case where a force acts that pushes the pen tip 911 in the direction toward the pen body 910, the pen tip 911 is moved into the interior of the pen body 910. When a force is acting on the pen tip 911, that is, when the pen tip 911 has moved into the interior of the pen body 910, the ultrasonic pen 91 transmits ultrasonic waves. When the force ceases to act on the pen tip 911, the pen tip 911 returns to the original projecting position.

As will be described in detail below, the sewing machine 1 can use the receivers 94, 95 to receive the ultrasonic waves that are transmitted from the ultrasonic pen 91. Based on the detected ultrasonic waves, the sewing machine 1 can specify the position of the transmission source of the ultrasonic waves, that is, a transmitter 915 (refer to FIG. 6), which is provided in the ultrasonic pen 91. The sewing machine 1 can perform sewing based on the specified position. For example, the user is able to perform sewing at the position on the work cloth 100 that was designated by the pressing of the pen tip 911 of the ultrasonic pen 91 against the work cloth 100 (refer to FIG. 6).

Figure 2:
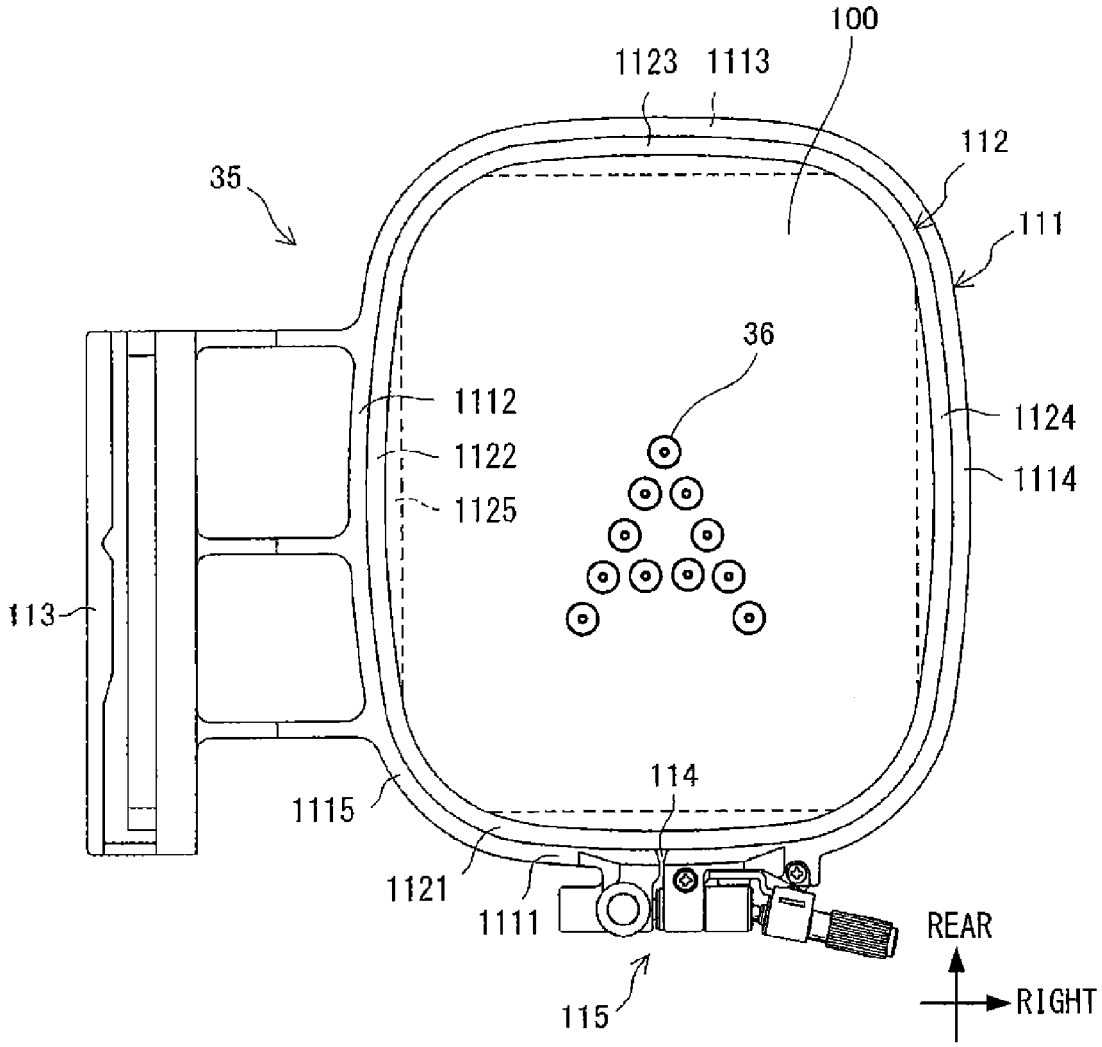
FIG. 2 is a top view that shows an embroidery frame that holds a work cloth on which sequins have been placed.

The embroidery frame 35 will be explained with reference to FIG. 2. The embroidery frame 35 has a substantially rectangular shape as seen in a plan view. The embroidery frame 35 includes the outer frame 111 and the inner frame 112. In FIG. 2, the portion of the work cloth 100 to the outside of the inner frame 112 is omitted to facilitate the explanation.

The outer frame 111 has four outer frame sides 1111 to 1114 that are positioned within a horizontal plane, as well as corner portions 1115. Each of the outer frame sides 1111 to 1114 is substantially straight. The corner portions 1115 are curved. The outer frame side 1112 is provided with a mounting portion 113, which may be connected to the frame holder 55. A parting portion 114 in the outer frame side 1111 is divided in a central portion of a longer dimension of the parting portion 114. A tightening mechanism 115 is provided in the parting portion 114. The tightening mechanism 115 is capable of tightening the outer frame 111 in relation to the inner frame 112.

The inner frame 112 is substantially rectangular. The inner frame 112 has four inner frame sides 1121 to 1124 that are positioned within a horizontal plane, as well as curved corner portions. A rib 1125 that projects to the inside of the embroidery frame 35 is formed at the bottom of the inner circumferential edge of each one of the inner frame sides 1121 to 1124. The inner frame 112 is reinforced by the ribs 1125. The inner frame 112, together with the outer frame 111, holds the work cloth 100 in a taut state.

Sequins 36 may be affixed by an adhesive to the work cloth 100 that is held in the embroidery frame 35. The sequins 36 may be affixed in the shape of a letter "A" in a plan view.

The receiver 94 will be described in detail with reference to FIGS. 3 to 5. The receiver 95 has the same structure as the receiver 94, so an explanation of the receiver 95 will be omitted.

Figure 3:
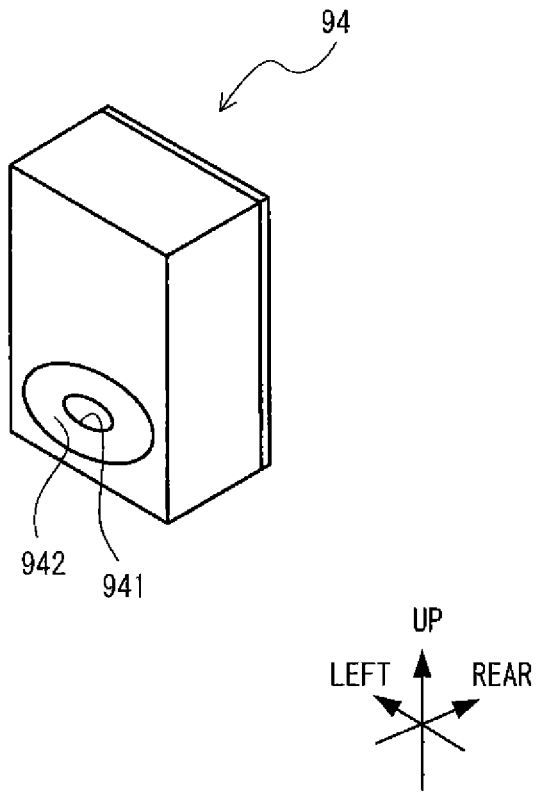
FIG. 3 is an oblique view of a receiver in the first embodiment.
Figure 4:
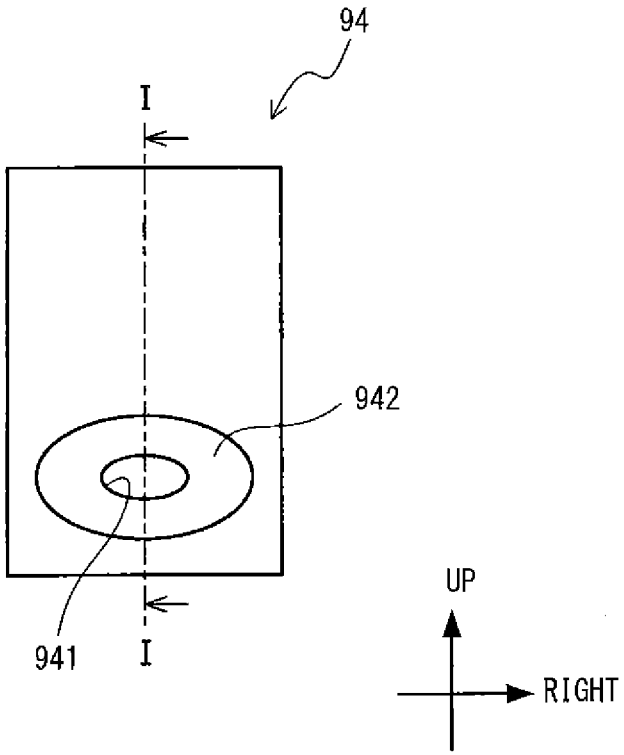
FIG. 4 is a front view of the receiver in the first embodiment.
Figure 5:
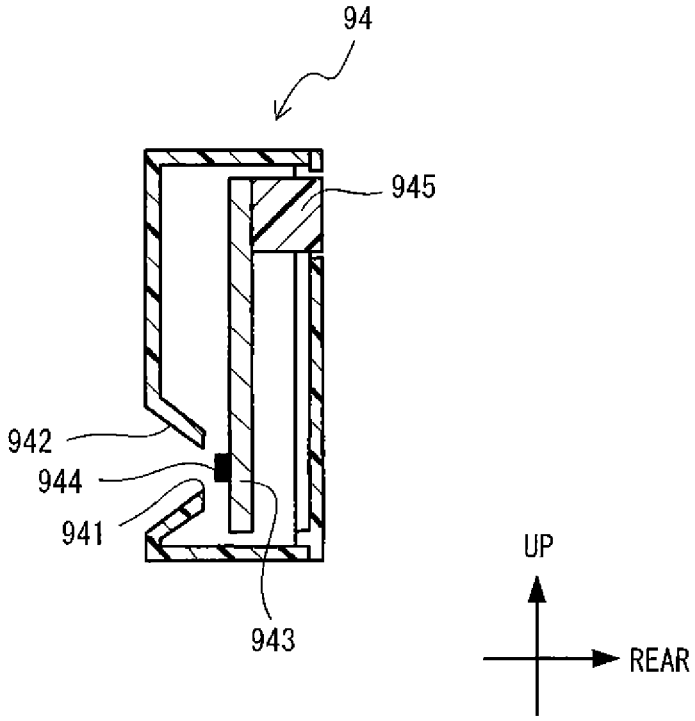
FIG. 5 is a section view of the receiver, as seen from the direction of arrows on a line I-I that is shown in FIG. 4.

As shown in FIGS. 3 and 4, the receiver 94 has a three-dimensional rectangular shape that is longer in the up-down direction. An opening 941 is provided in the center of the lower portion of the front face of the receiver 94. The opening 941 has an elliptical shape whose long axis extends in the left-right direction. A surrounding portion 942 around the opening 941 is a tapered surface that is inclined radially toward the front side. As shown in FIG. 5, an electronic substrate 943 and a microphone 944 are provided in the interior of the receiver 94. The microphone 944 is positioned on the inner side of the opening 941. A receiver connector 945 is provided on the rear face of the upper end of the electronic substrate 943. The receiver connector 945 may be connected to a connector (not shown in the drawings) that is provided in the sewing machine 1. The directionality of the receiver 94 is determined by the orientation of the opening 941 in relation to the microphone 944.

Electrical Configurations of the Sewing Machine 1 and the Ultrasonic Pen 91

Figure 6:
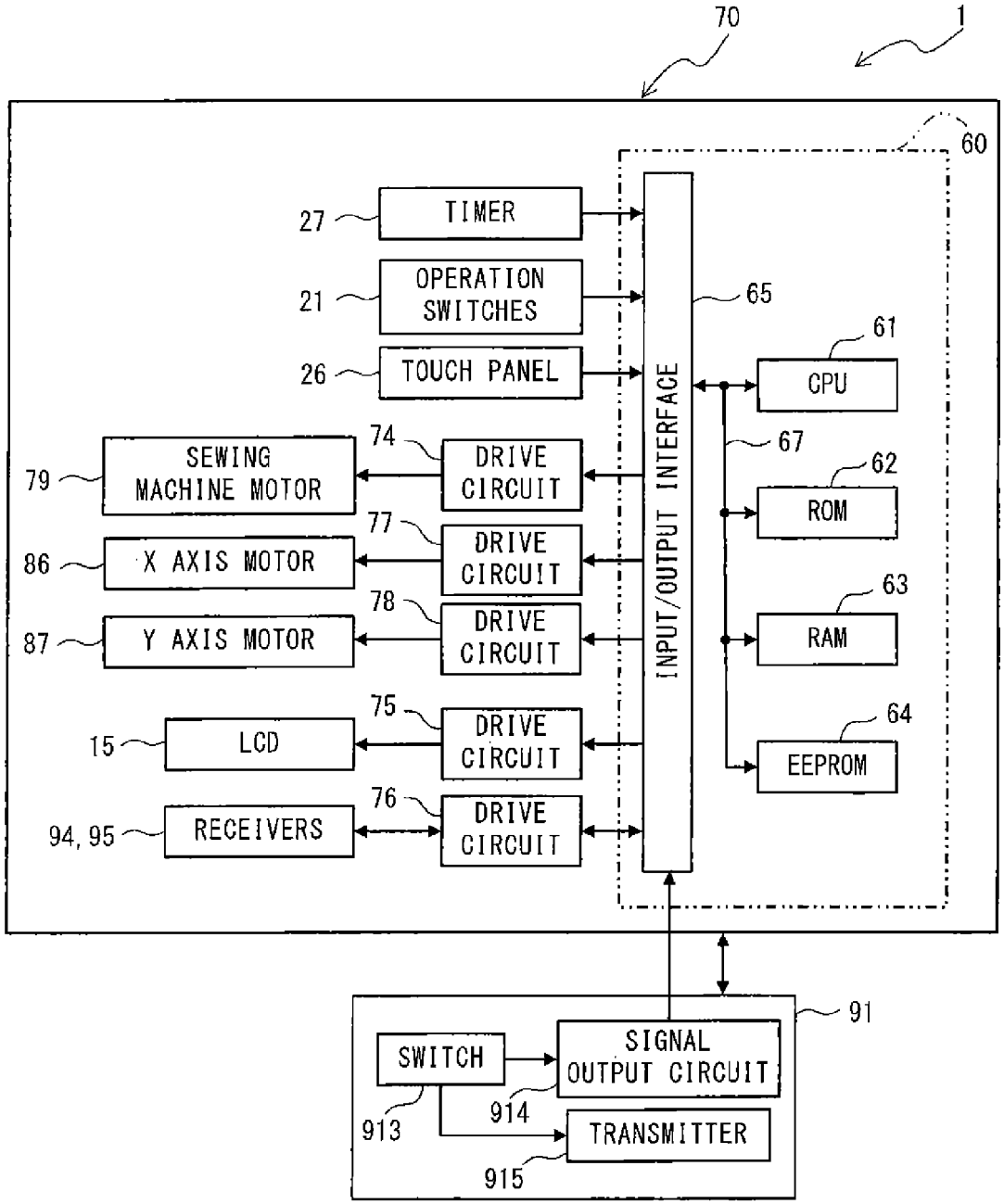
FIG. 6 is a block diagram that shows electrical configurations of the sewing machine and an ultrasound pen of the first embodiment.

The electrical configurations of the sewing machine 1 and the ultrasonic pen 91 will be explained with reference to FIG. 6. A control portion 60 of the sewing machine 1 includes the CPU 61, a ROM 62, a RAM 63, an EEPROM 64, and an input/output interface 65. The CPU 61, the ROM 62, the RAM 63, the EEPROM 64, and the input/output interface 65 are electrically connected to one another via a bus 67. The ROM 62 stores various types of programs, data, and the like, including a sewing program 500 for the CPU 61 to perform main processing that will be described below. The EEPROM 64 stores data for a plurality of types of stitch shapes for the sewing machine 1 to perform sewing on the work cloth 100, and also stores various types of parameters and the like.

The operation switches 21, the touch panel 26, a timer 27, and drive circuits 74 to 78 are electrically connected to the input/output interface 65. The timer 27 may measure time. The drive circuits 74, 75, 77, 78 may respectively drive the sewing machine motor 79, the LCD 15, the X axis motor 86, and the Y axis motor 87. The drive circuit 76 may drive the receivers 94, 95. The drive circuit 76 includes an amplifier circuit. The amplifier circuit generates a detection signal by amplifying the ultrasonic wave signals that are detected by the receivers 94, 95. The drive circuit 76 outputs the detection signal to the CPU 61 through the input/output interface 65.

The ultrasonic pen 91 includes a switch 913, a signal output circuit 914, and the transmitter 915. The switch 913 is electrically connected to the signal output circuit 914 and the transmitter 915. The signal output circuit 914 is electrically connected to the input/output interface 65. The switch 913 turns on and off in accordance with the position of the pen tip 911. In a case where the switch 913 is not being pressed, that is, is in the off state, the signal output circuit 914 outputs a high signal to the CPU 61 via the cable 912 and the input/output interface 65. In a case where the switch 913 is being pressed, that is, is in the on state, the signal output circuit 914 outputs a low signal (hereinafter referred to as the transmission start signal) to the CPU 61 via the cable 912 and the input/output interface 65. When the user presses the pen tip 911 against the work cloth 100, the switch 913 turns on, and the transmitter 915 transmits the ultrasonic waves. The switch 913, the signal output circuit 914, and the transmitter 915 are provided in the interior of the pen body 910.

Data Configurations

Figure 7:
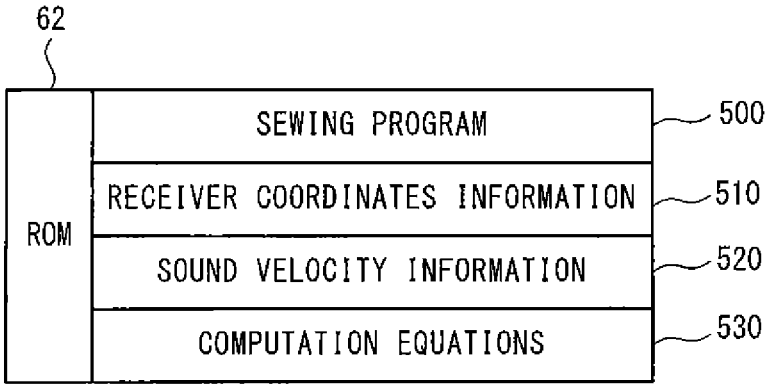
FIG. 7 is an explanatory figure that shows a configuration of data that are stored in a ROM.
Figure 8:
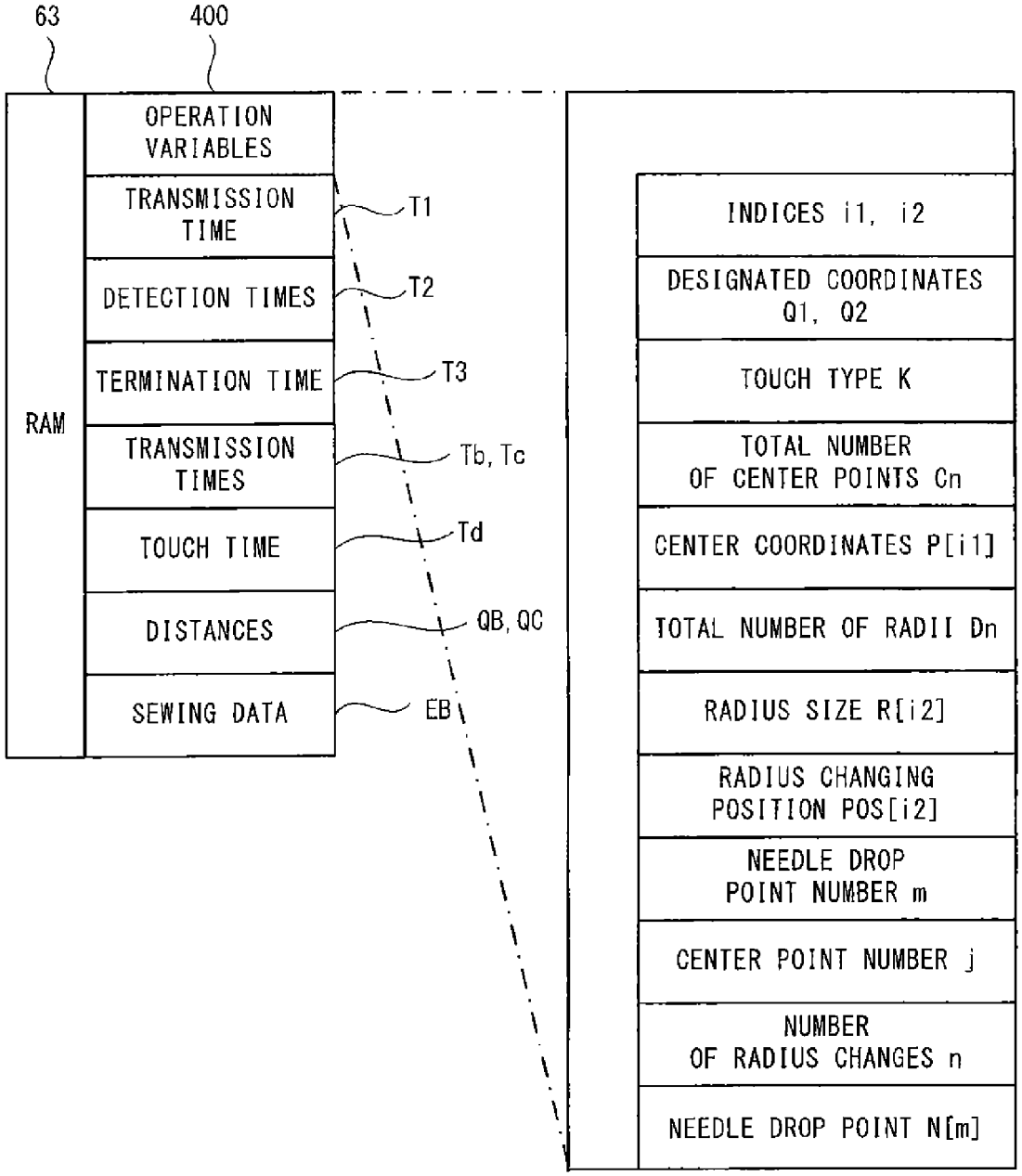
FIG. 8 is an explanatory figure that shows a configuration of data that are stored in a RAM.

The configurations of the data that are stored in the ROM 62 and the RAM 63 will be explained with reference to FIGS. 7 and 8. As shown in FIG. 7, the ROM 62 stores the sewing program 500, receiver coordinates information 510, sound velocity information 520, and computation equations 530. The sewing program 500 is a program for implementing sequin sewing processing (refer to FIG. 10). The receiver coordinates information 510, the sound velocity information 520, and the computation equations 530 may be read from the ROM 62 in the course of specifying the position that has been designated by the ultrasonic pen 91. As shown in FIG. 8, the RAM 63 functions as a temporary storage area where various types of variables and the like are stored that the CPU 61 references when executing the sewing program 500 that is stored in the ROM 62. The various types of variables include, for example, operation variables 400, as well as a transmission time T1, detection times T2, a termination time T3, transmission times Tb, Tc, a touch time Td, distances QB, QC, and sewing data EB, which will be described below.

Operation Variables 400

The operation variables 400 will be explained in detail. The operation variables 400 include indices i1, i2, designated coordinates Q1, Q2, a touch type K, a total number of center points Cn, center coordinates P[i1], a total number of radii Dn, a radius size R[i2], a radius changing position POS[i2], a needle drop point number m, a center point number j, a number of radius changes n, and a needle drop point N[m]. The index i1 indicates the current number of center points. The index i2 indicates the current number of radii. The designated coordinates Q1, Q2 indicate the designated coordinates Q (described below) that have been designated by the ultrasonic pen 91. The touch type K indicates a type of touch, based on a length of time of touching by the ultrasonic pen 91. The total number of center points Cn indicates the total number of the sequins 36. The center coordinates P[i1] indicates the positional coordinates of the center point of a hole in the i1-th sequin 36. The total number of radii Dn indicates a total number of radius changes. The radius size R[i2] indicates the size of the i2-th radius that has been designated by the ultrasonic pen 91. The radius changing position POS[i2] indicates the number of the center point at a time when the radius size changes. The needle drop point N[m] indicates the point on the work cloth 100 that is to be pierced by the sewing needle.

Method of Specifying the Position Designated by the Ultrasonic Pen 91

Figure 9:
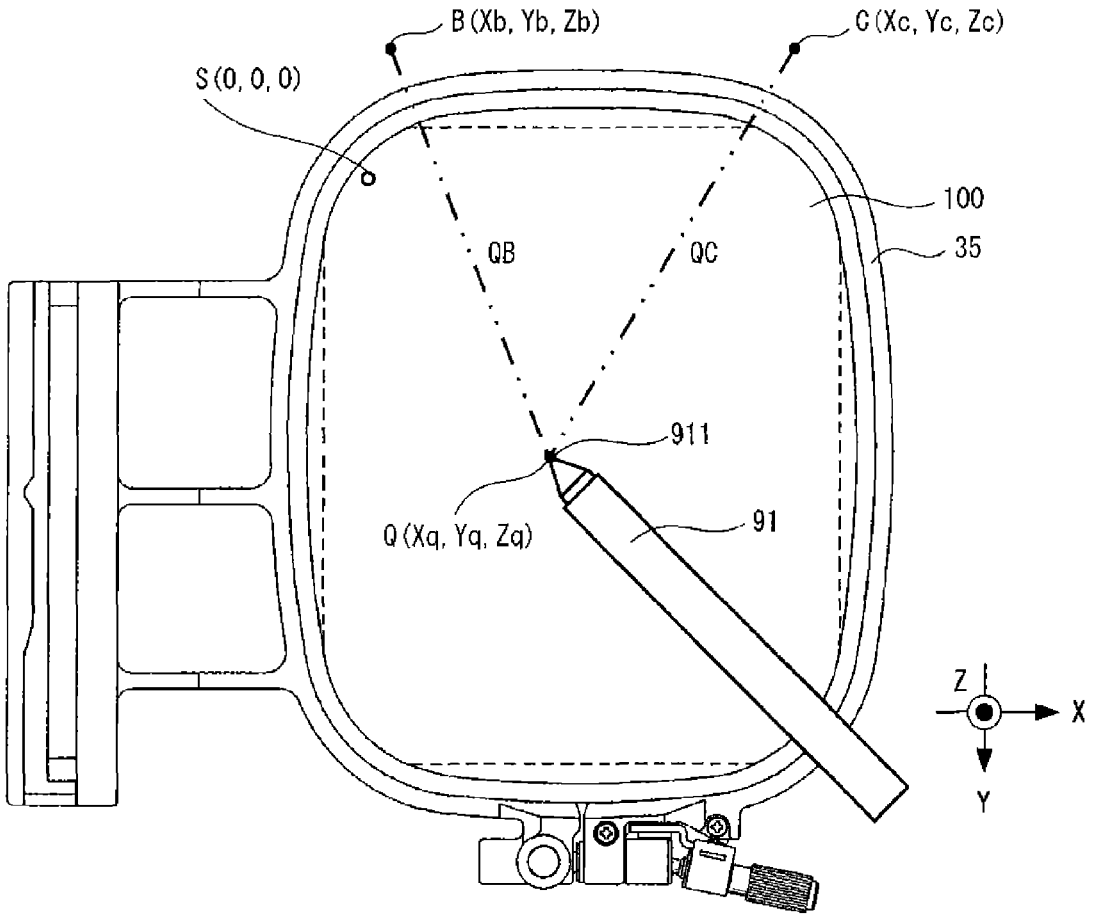
FIG. 9 is a figure for explaining a method of computing designated coordinates in the first embodiment.

A method of specifying the position on the work cloth 100 that has been designated by the ultrasonic pen 91 will be explained with reference to FIG. 9. By causing the pen tip 911 of the ultrasonic pen 91 to touch the work cloth 100, the user may designate a position on the work cloth 100 where sewing is to be performed by the sewing machine 1. Hereinafter, the position on the work cloth 100 that the pen tip 911 of the ultrasonic pen 91 has touched is referred to as the designated position. In the present embodiment, the designated position is as assumed to be a position that is inside the embroidery frame 35. The sewing machine 1 can may specify the designated position by specifying the position of the transmission source of the ultrasonic waves, as will be described below. Strictly speaking, the position that is specified as the position of the transmission source of the ultrasonic waves is not the position on the work cloth 100 that the pen tip 911 has touched, but is the position of the transmitter 915 that is provided in the ultrasonic pen 91. However, the pen tip 911 and the transmitter 915 are located extremely close to one another. Therefore, the position of the transmitter 915 can be regarded as the position on the work cloth 100 that the pen tip 911 has touched, that is, as the designated position. Hereinafter, the left-right direction, the front-rear direction, and the up-down direction in the sewing machine 1 are respectively defined as the X axis direction, the Y axis direction, and the Z axis direction.

The sewing machine 1 may specify the designated position in the form of coordinate information (an X coordinate, a Y coordinate, and a Z coordinate). In the explanation that follows, each increment of 1 in the X coordinate, the Y coordinate, and the Z coordinate is equivalent to a distance of one millimeter. An origin point S (0, 0, 0) of the coordinate system is a point in the left rear corner of the embroidery frame 35. The top face of a needle plate is defined as the plane on which the Z coordinate is zero. Coordinates B that indicate the position of the receiver 94 are defined as (Xb, Yb, Zb). Coordinates C that indicate the position of the receiver 95 are defined as (Xc, Yc, Zc). The coordinates Q that indicate the designated position are defined as (Xq, Yq, Zq). Hereinafter, the coordinates Q is referred to as the designated coordinates Q. The respective Z coordinates of the receivers 94, 95 indicate the heights of the receivers 94, 95 in relation to the top face of the needle plate. The distance between the designated coordinates Q and the coordinates B is referred to as the distance QB. The distance between the designated coordinates Q and the coordinates C is referred to as the distance QC.

Based on the Pythagorean theorem, the distances QB, QC can be described by the coordinates B, C, Q. The relationship between the distance QB and the coordinates B, Q is described by Equation (1) below. In the same manner, the relationship between the distance QC and the coordinates C, Q is described by Equation (2) below.

$$(Xb-Xq)^2+(Yb-Yq)^2+(Zb-Zq)^2=(QB)^2 \quad (1)$$

$$(Xc-Xq)^2+(Yc-Yq)^2+(Zc-Zq)^2=(QC)^2 \quad (2)$$

Equation (1) is identical to an equation for a spherical surface for which the coordinates B define the center point, that has a radius of the distance QB, and that intersects the designated coordinates Q. In the same manner, Equation (2) is identical to an equation for a spherical surface for which the coordinates C define the center point, that has a radius of the distance QC, and that intersects the designated coordinates Q.

The velocity at which the ultrasonic waves travel is the sound velocity V. The time that is required for the ultrasonic waves that are transmitted from the ultrasonic pen 91 that is at the designated coordinates Q to arrive at the receiver 94 is defined as the transmission time Tb. The time that is required for the ultrasonic waves that are transmitted from the ultrasonic pen 91 that is at the designated coordinates Q to arrive at the receiver 95 is defined as the transmission time Tc. In this case, the distances QB, QC can respectively be described by Equations (3) and (4) below.

$$QB=V\times Tb \quad (3)$$

$$QC=V\times Tc \quad (4)$$

Substituting Equations (3) and (4) into Equations (1) and (2) yields Equations (5) and (6) below.

$$(Xb-Xq)^2+(Yb-Yq)^2+(Zb-Zq)^2=(V\times Tb)^2 \quad (5)$$

$$(Xc-Xq)^2+(Yc-Yq)^2+(Zc-Zq)^2=(V\times Tc)^2 \quad (6)$$

In Equations (5) and (6), the coordinates B (Xb, Yb, Zb), the coordinates C (Xc, Yc, Zc), and the sound velocity V are known values that have been stored in advance in the ROM 62 as the receiver coordinates information 510 and the sound velocity information 520. The Equations (1) to (6) are stored in the ROM 62 in advance as the computation equations 530. The transmission times Tb, Tc are specified by computing the differences between the time that the ultrasonic waves are transmitted from the transmitter 915 of the ultrasonic pen 91 and the times that the ultrasonic waves are detected by the receivers 94, 95. Hereinafter, the time when the ultrasonic waves are transmitted from the transmitter 915 is referred to as the transmission time T1. The pair of times when the ultrasonic waves are detected by the receivers 94, 95, respectively, are referred to as the detection times T2. The value for the thickness of work cloth 100 is so much smaller than the values for Zb and Zc that the value of the thickness can be ignored. Therefore, among the designated coordinates Q (Xq, Yq, Zq), Zq is a value that can be regarded as being zero. Accordingly, the respective values for Xq and Yq can be computed based on the simultaneous Equations (5) and (6) and on the directionalities of the receivers 94, 95. In this manner, the designated coordinates Q (Xq, Yq, Zq (=0)) that have been designated on the work cloth 100 by the ultrasonic pen 91 can be computed.

Sequin Sewing Processing

The sequin sewing processing will be explained with reference to FIG. 10. The sequin sewing processing may be performed by the CPU 61 in accordance with the sewing program 500 that is stored in the ROM 62. The CPU 61 performs the sequin sewing processing in a case where the pen connector 916 of the ultrasonic pen 91 has been electrically connected to the pen connector 40 and a sequin sewing mode has been selected via the touch panel 26. Each of the steps that are shown in the flowchart of the sequin sewing processing indicates processing by the CPU 61.

The user may use an adhesive to temporarily affix the plurality of the sequins 36 to the work cloth 100 that is mounted in the embroidery frame 35, as shown in FIG. 2. The adhesive strength of the adhesive need only be strong enough that the sequins 36 do not separate from the work cloth 100.

At Step S1, the CPU 61 performs position specification processing. Specifically, based on the times when the receivers 94, 95 detect the ultrasonic waves, the CPU 61 specifies at least positions inside the holes in the sequins 36 that have been disposed on the work cloth 100. When the user presses the pen tip 911 against a position inside the hole in one of the sequins 36, ultrasonic waves are transmitted from the transmitter 915. The position inside the hole in the sequin 36 may be, for example, the center position of the hole in the sequin 36. However, the position inside the hole in the sequin 36 may also be a position other than the center position of the hole in the sequin 36. The outer size of the sequin 36 may be indicated by the radius of the outer circle of the sequin 36, for example. The position specification processing will be described in detail below, with reference to FIG. 11.

At Step S3, the CPU 61 performs sewing data creation processing. The sewing data creation processing is processing that creates the sewing data EB based on the positions inside the holes in the sequins 36 that were specified at Step S1. The sewing data EB includes needle drop point data and thread color data. The needle drop point data indicates the points on the work cloth 100 that is to be pierced by the sewing needle. The thread color data indicates the color of a thread. The sewing data EB are data for sewing the sequins 36 onto the work cloth 100. The sewing data creation processing will be described in detail below, with reference to FIG. 13.

When the start/stop switch is pressed, the CPU 61, at Step S5, controls the sewing machine 1 such that the sewing machine 1 sews the sequins 36 onto the work cloth 100 based on the sewing data EB that were created at Step S3. After completing the processing at Step S5, the CPU 61 terminates the sequin sewing processing.

Position Specification Processing

The position specification processing will be explained in detail with reference to FIG. 11. When the CPU 61 starts the position specification processing at Step S1, the CPU 61 advances the processing to Step S11. At Step S11, the CPU 61 writes zero to the indices i1, i2.

At Step S13, the CPU 61 determines whether the work cloth 100 has been touched by the ultrasonic pen 91. Specifically, the CPU 61 determines whether the switch 913 of the ultrasonic pen 91 has been turned on. In a case where the work cloth 100 has been touched by the ultrasonic pen 91 (YES at Step S13), the CPU 61 advances the processing to Step S15. In a case where the work cloth 100 has not been touched by the ultrasonic pen 91 (NO at Step S13), the CPU 61 repeats the processing at Step S13.

Figure 16:
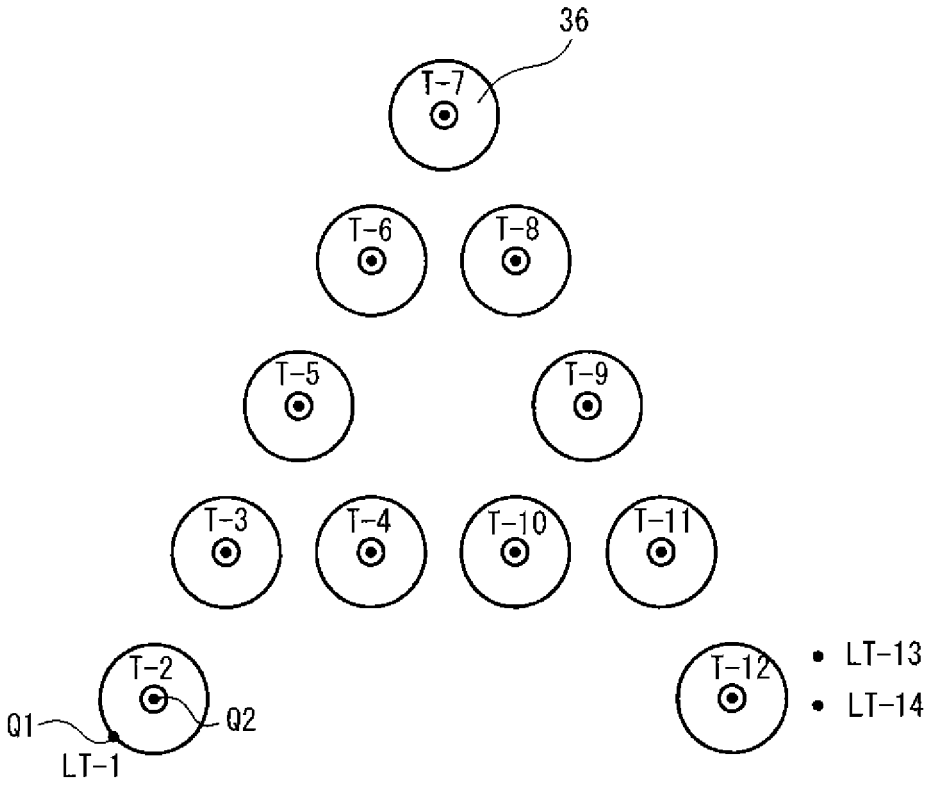
FIG. 16 is a top view that shows touch positions on the work cloth in a second specific example.

At Step S15, the CPU 61 performs touch detection processing that detects the touch type K and the designated coordinates Q1 of the touch by the ultrasonic pen 91. Specifically, the CPU 61 writes the designated coordinates Q to the designated coordinates Q1 and writes a number that indicates the type of touch to the touch type K. For example, the touch type K is set to the number 1 to indicate a long touch or to the number 2 to indicate a regular touch. For example, in a case where the designated coordinates Q1 are (1, 3, 0) and the touch type K is 1, as shown in FIG. 16, designated coordinates LT-1 for a long touch are (1, 3, 0). The touch detection processing will be described in detail below, with reference to FIG. 12. A long touch is a touch for which the touch time is not less than one second. A regular touch is a touch for which the touch time is less than one second.

At Step S17, the CPU 61 determines whether the type of touch by the ultrasonic pen 91 is a long touch. In a case where the CPU 61 determines that the type of touch by the ultrasonic pen 91 is a long touch (YES at Step S17), the CPU 61 advances the processing to Step S23. In a case where the CPU 61 determines that the type of touch by the ultrasonic pen 91 is not a long touch (NO at Step S17), the CPU 61 advances the processing to Step S19. For example, in a case where the touch type K is the number 1, which indicates a long touch, the CPU 61 advances the processing to Step S23. In a case where the touch type K is the number 2, which indicates a regular touch, the CPU 61 advances the processing to Step S19.

At Step S19, the CPU 61 writes the designated coordinates Q1 to the i1-th center coordinates P[i1]. For example, in a case where the designated coordinates Q1 are (1, 3, 0) and the index i1 is zero, the CPU 61 writes the designated coordinates Q1 (1, 3, 0) to the 0-th center coordinates P[0]. After completing the processing at Step S19, the CPU 61 advances the processing to Step S21.

At Step S21, the CPU 61 adds 1 to the index i1, which indicates the number of the current center point. For example, in a case where the index i1 is zero, the index i1 becomes 1 when 1 is added to zero. After completing the processing at Step S21, the CPU 61 returns the processing to Step S13.

At Step S23, in the same manner as at Step S13, the CPU 61 determines whether the work cloth 100 has been touched by the ultrasonic pen 91. Specifically, the CPU 61 determines whether the switch 913 of the ultrasonic pen 91 has been turned on. In a case where the work cloth 100 has been touched by the ultrasonic pen 91 (YES at Step S23), the CPU 61 advances the processing to Step S25. In a case where the work cloth 100 has not been touched by the ultrasonic pen 91 (NO at Step S23), the CPU 61 repeats the processing at Step S23.

At Step S25, the CPU 61 performs the touch detection processing that detects the touch type K and the designated coordinates Q2 of the touch by the ultrasonic pen 91. Specifically, the CPU 61 writes the designated coordinates Q to the designated coordinates Q2 and writes a number that indicates the type of touch to the touch type K. For example, in a case where the designated coordinates Q2 are (2, 2, 0) and the touch type K is 2, as shown in FIG. 16, designated coordinates T-2 for a regular touch are (2, 2, 0). The touch detection processing that is performed at Step S25 is processing that is identical to the touch detection processing that is performed at Step S15.

At Step S27, the CPU 61 determines whether the type of touch by the ultrasonic pen 91 is a long touch. In a case where the CPU 61 determines that the type of touch by the ultrasonic pen 91 is a long touch (YES at Step S27), the CPU 61 advances the processing to Step S35. In a case where the CPU 61 determines that the type of touch by the ultrasonic pen 91 is not a long touch (NO at Step S27), the CPU 61 advances the processing to Step S29. For example, in a case where the touch type K is the number 1, which indicates a long touch, the CPU 61 advances the processing to Step S35. In a case where the touch type K is the number 2, which indicates a regular touch, the CPU 61 advances the processing to Step S29.

At Step S29, the CPU 61 specifies the outer size of the sequin 36 based on the distance between the designated coordinates Q1 and the designated coordinates Q2. The designated coordinates Q1 are the coordinates of a first position, against which the pen tip 911 was pressed for a long touch. The designated coordinates Q2 are the coordinates of a second position, against which the pen tip 911 was pressed for a regular touch, following the touch at the designated coordinates Q1 that indicate the first position. Specifically, the CPU 61 writes the distance between the designated coordinates Q1 and the designated coordinates Q2 to the radius size R[i2] for the sequin 36. The CPU 61 also writes the index i1 to the radius changing position POS[i2]. For example, in a case where the designated coordinates Q1 are (1, 3, 0), the designated coordinates Q2 are (2, 2, 0), and the index i2 is zero, the radius size R[0] for the 0-th sequin 36 becomes the absolute value of Q2−Q1, that is, the absolute value of (2-1, 2-3, 0), which is the square root of 2. In a case where the index i1 is 1 and the index i2 is zero, the radius changing position POS [0] equals 1.

At Step S1, the CPU 61 adds 1 to the index i2. For example, in a case where the index i2 is zero, the index i2 becomes 1 when 1 is added to zero.

At Step S33, the CPU 61 writes the designated coordinates Q2, which were designated by a regular touch after one long touch, to the designated coordinates Q1. After completing the processing at Step S33, the CPU 61 returns the processing to Step S19.

At Step S35, the CPU 61 writes the index i1 to the total number of center points Cn. The CPU 61 writes the index i2 to the total number of radii Dn. After completing Step S35, the CPU 61 terminates the position specification processing. After terminating the position specification processing, the CPU 61 returns to the sequin sewing processing that is shown in FIG. 10 and advances the processing to the sewing data creation processing (Step S3).

Touch Detection Processing

The touch detection processing will be explained in detail with reference to FIG. 12. The CPU 61 performs the touch detection processing at Steps S15 and S25 in the position specification processing that is shown in FIG. 11. When the CPU 61 starts the touch detection processing, the CPU 61 advances the processing to Step S51.

At Step S51, the CPU 61 determines whether the transmission start signal that is output from the signal output circuit 914 of the ultrasonic pen 91 has been detected via the cable 912. In a case where the CPU 61 determines that the transmission start signal has been detected (YES at Step S51), the CPU 61 advances the processing to Step S53. In a case where the CPU 61 determines that the transmission start signal has not been detected (NO at Step S51), the CPU 61 repeats the processing at Step S51. In a case where the user has used the ultrasonic pen 91 to designate a desired position on the work cloth 100 and that the pen tip 911 of the ultrasonic pen 91 has touched the work cloth 100, the pen tip 911 is moved into the pen body 910 and the switch 913 turns on. At this time, the signal output circuit 914 outputs the transmission start signal to the CPU 61. In a case where the switch 913 of the ultrasonic pen 91 has turned on, the transmitter 915 transmits the ultrasonic waves at the same time that the signal output circuit 914 outputs the transmission start signal. However, the speed at which the transmission start signal travels to the CPU 61 is much greater than the speed at which the detection signal travels from the drive circuit 76 to the CPU 61. Therefore, the transmission start signal arrives at the CPU 61 at substantially the same time that the switch 913 turns on. When the transmission start signal arrives at the CPU 61, the CPU 61 determines that the transmission start signal has been detected.

At Step S53, the CPU 61 specifies the time when the transmission start signal was detected by referring to the timer 27. The CPU 61 acquires the time when the transmission start signal was detected as the transmission time T1 for the ultrasonic waves. The CPU 61 stores the acquired transmission time T1 in the RAM 63.

At Step S55, the CPU 61 determines whether the ultrasonic waves that were transmitted from the ultrasonic pen 91 have been detected via one of the receiver 94 and the receiver 95. Specifically, when the ultrasonic waves are detected by one of the receiver 94 and the receiver 95, the ultrasonic wave signal is output to the drive circuit 76. In this case, the drive circuit 76 outputs the detection signal to the CPU 61 via the input/output interface 65. When the CPU 61 receives the detection signal, the CPU 61 determines that the ultrasonic waves have been detected via one of the receiver 94 and the receiver 95. In a case where the CPU 61 has determined that the ultrasonic waves have been detected via one of the receiver 94 and the receiver 95 (YES at Step S55), the CPU 61 advances the processing to Step S57. In a case where the CPU 61 has determined that the ultrasonic waves have not been detected via one of the receiver 94 and the receiver 95 (NO at Step S55), the CPU 61 advances the processing to Step S67.

At Step S67, the CPU 61, by referring to the timer 27, determines whether a specified length of time has elapsed since the transmission time T1. The specified length of time is a length of time that is sufficient for the ultrasonic waves to be transmitted from the ultrasonic pen 91 on the work cloth 100 that is held in the embroidery frame 35 and to arrive at the receivers 94, 95. The specified length of time may be one second, for example. In a case where the CPU 61 has determined that the specified length of time has elapsed since the transmission time T1 (YES at Step S67), the CPU 61 advances the processing to Step S69. In a case where the CPU 61 has determined that the specified length of time has not elapsed since the transmission time T1 (NO at Step S67), it returns the processing to Step S55. In other words, the CPU 61 waits for the receiver 94 and the receiver 95 to detect the ultrasonic waves until the specified length of time elapses. For example, the ultrasonic waves that have been transmitted from the transmitter 915 of the ultrasonic pen 91 may be blocked by the user's hand or arm, or by the work cloth 100 or the like, such that the ultrasonic waves do not arrive at at least one of the receiver 94 and the receiver 95 within the specified length of time. In this case, since the specified length of time elapses in a state in which the receiver 94 and the receiver 95 are not able to detect the ultrasonic waves, the CPU 61 advances the processing to Step S69.

At Step S69, the CPU 61 controls the drive circuit 75 such that an error message is displayed on the LCD 15. The error message indicates that the receiver 94 and the receiver 95 were not able to detect the ultrasonic waves. Having seen the error message, the user may once again designate the desired position on the work cloth 100 with the ultrasonic pen 91. After completing the processing at Step S69, the CPU 61 returns the processing to Step S51 in order to detect once again the transmission start signal that is output from the signal output circuit 914 of the ultrasonic pen 91.

At Step S57, the CPU 61, by referring to the timer 27, specifies the time when the ultrasonic waves were detected by one of the receiver 94 and the receiver 95. The CPU 61 stores the time when the ultrasonic waves were detected as the detection time T2 in the RAM 63. Specifically, the time when the ultrasonic waves were detected by one of the receiver 94 and the receiver 95 is the time when the CPU 61 detected the detection signal.

At Step S59, the CPU 61 determines whether the ultrasonic waves have been detected by both of the receiver 94 and the receiver 95. In a case where the CPU 61 has determined that the ultrasonic waves have been detected by both of the receiver 94 and the receiver 95 (YES at Step S59), the CPU 61 advances the processing to Step S60. In a case where the CPU 61 has determined that one of the receiver 94 and the receiver 95 has not detected the ultrasonic waves (NO at Step S59), the CPU 61 returns the processing to Step S55.

At Step S60, the CPU 61 determines whether the transmission start signal has ceased to be detected. In a case where the CPU 61 has determined that the transmission start signal has ceased to be detected (YES at Step S60), the CPU 61 advances the processing to Step S61. In a case where the CPU 61 has determined that the transmission start signal has not ceased to be detected (NO at Step S60), the CPU 61 repeats the processing at Step S60.

At Step S61, the CPU 61, by referring to the timer 27, specifies the time when the transmission start signal ceased to be detected. The CPU 61 stores, in the RAM 63 as the termination time T3, the time when the transmission start signal ceased to be detected.

At Step S62, the CPU 61 computes the touch time Td. Specifically, the CPU 61 computes the touch time Td by subtracting the transmission time T1 from the termination time T3. The CPU 61 stores the touch time Td in the RAM 63.

At Step S63, the CPU 61 computes the touch type K based on the touch time Td. Specifically, in a case where the touch time Td is not less than a differentiation value, the CPU 61 writes the number 1, which indicates a long touch, to the touch type K. In a case where the touch time Td is less than the differentiation value, the CPU 61 writes the number 2, which indicates a regular touch, to the touch type K. The CPU 61 stores the touch type K in the RAM 63. The differentiation value may be one second, for example.

At Step S64, the CPU 61 computes the transmission times Tb, Tc. Specifically, the CPU 61 computes the transmission time Tb by subtracting the transmission time T1 from the detection time T2 for the receiver 94. The CPU 61 computes the transmission time Tc by subtracting the transmission time T1 from the detection time T2 for the receiver 95. The CPU 61 stores the transmission times Tb, Tc in the RAM 63.

At Step S65, the CPU 61, based on Equations (3) and (4) among the computation equations 530, computes the distances QB, QC by multiplying the sound velocity V by the transmission times Tb, Tc, which were computed at Step S64. The CPU 61 stores the distances QB, QC in the RAM 63.

At Step S66, the CPU 61 computes the designated coordinates Q (Xq, Yq, Zq (=0)) by solving the simultaneous Equations (5) and (6) among the computation equations 530, using the coordinates B (Xb, Yb, Zb), the coordinates C (Xc, Yc, Zc), and the distances QB, QC in the equations. The CPU 61 thus specifies the designated coordinates Q on the work cloth 100 that have been designated by the ultrasonic pen 91. The CPU 61 stores the designated coordinates Q in the RAM 63 as the designated coordinates Q1. After completing Step S66, the CPU 61 terminates the touch detection processing. After terminating the touch detection processing, the CPU 61 returns to the position specification processing that is shown in FIG. 11. In a case where the CPU 61 performed the touch detection processing at Step S15, the CPU 61 advances the processing to Step S17. In a case where the CPU 61 performed the touch detection processing at Step S25, the CPU 61 advances the processing to Step S27.

Sewing Data Creation Processing

The sewing data creation processing will be explained in detail with reference to FIG. 13. In addition to making settings for causing the sewing needle to pierce the work cloth 100 at a position inside the hole in the sequin 36, the sewing data creation processing is able to make settings for causing the sewing needle to pierce the work cloth 100 at three positions outside of the sequin 36.

At Step S80, the CPU 61 determines whether or not the total number of radii Dn equals zero. In a case where the CPU 61 has determined that the total number of radii Dn equals zero (YES at Step S80), the CPU 61 advances the processing to Step S99. In a case where the CPU 61 has determined that the total number of radii Dn does not equal zero (NO at Step S80), the CPU 61 advances the processing to Step S81.

At Step S99, the CPU 61 writes each one of the center coordinates P[ ] to the coordinates for the corresponding needle drop point N[ ], then terminates the sewing data creation processing.

At Step S81, the CPU 61 writes zero to the center point number j, the needle drop point number in, and the number of radius changes n.

At Step S83, the CPU 61 determines whether the radius changing position POS[n] equals j. In a case where the CPU 61 has determined that the radius changing position POS[n] equals j (YES at Step S83), the CPU 61 advances the processing to Step S85. In a case where the CPU 61 has determined that the radius changing position POS[n] does not equal j (NO at Step S83), the CPU 61 advances the processing to Step S87.

At Step S85, the CPU 61 adds 1 to the number of radius changes n in order to change the radius size R[n] of the sequin 36.

At Step S87, the CPU 61 determines whether the center point number j is less than the total number of center points Cn. In a case where the CPU 61 has determined that the center point number j is less than the total number of center points Cn (YES at Step S87), the CPU 61 advances the processing to Step S89. In a case where the CPU 61 has determined that the center point number j is not less than the total number of center points Cn (NO at Step S87), the CPU 61 terminates the sewing data creation processing. After terminating the sewing data creation processing, the CPU 61 returns to the sequin sewing processing that is shown in FIG. 10 and advances the processing to Step S5.

At Step S89, the CPU 61 writes the center coordinates P[j] to the needle drop points N[m], N[m+2], N[m+4], N[m+6].

At Step S91, the CPU 61 writes, to the needle drop point N[m+1], the coordinates of the point of intersection between a line segment PPj and a circumference Cj. When the center point number j is greater than zero, the line segment PPj is a line segment that links the (j−1)-th center coordinates P[j−1] and the j-th center coordinates P[j]. When the center point number j equals zero, the line segment PPj is a line segment that links the center coordinates P[0] and the point of intersection between the circumference Cj and a line segment that is formed by rotating a line segment that links the center coordinates P[0] and the center coordinates P[1] by 120 degrees counterclockwise around the center coordinates P[0]. The circumference Cj is a circumference that has the center of the circumference at the center coordinates P[j] and whose radius is the radius size R[n−1] plus a correction value a. The correction value a is specifically a fixed value that indicates the distance between a position on the line segment PPj that is on the outer circumference of the sequin 36 and a position on the line segment PPj that is outside the sequin 36. The correction value a may be 2 millimeters, for example.

At Step S93, the CPU 61 writes, to the needle drop point N[m+3], the coordinates of a point, on the circumference Cj, at β/2 degrees from the needle drop point N[m+1] within the range of an angle β that is the larger of the angles between the line segment PPj and a line segment PP(j+1). When the center point number j is less than the total number of center points Cn, the line segment PP(j+1) is a line segment that links the j-th center coordinates P[j] and the (j+1)-th center coordinates P[j+1]. When the center point number j equals the total number of center points Cn, the line segment PP(j+1) is a line segment that links the center coordinates P[Cn−1] and the point of intersection between the circumference Cj and a line segment that is formed by rotating a line segment that links the center coordinates P[Cn−1] and the center coordinates P[Cn] by 120 degrees counterclockwise around the center coordinates P[Cn].

At Step S95, the CPU 61 writes, to the needle drop points N[m+5], N[m+7], the coordinates of the point of intersection between the line segment PP(j+1) and the circumference Cj. The needle drop points N[m+1], N[m+3], N[m+5], N[m+7] indicate positions that are located outside of the sequin 36.

At Step S97, the CPU 61 adds 1 to the center point number j and adds 8 to the needle drop point number m. After completing the processing at Step S97, the CPU 61 returns the processing to Step S83.

Figure 10:
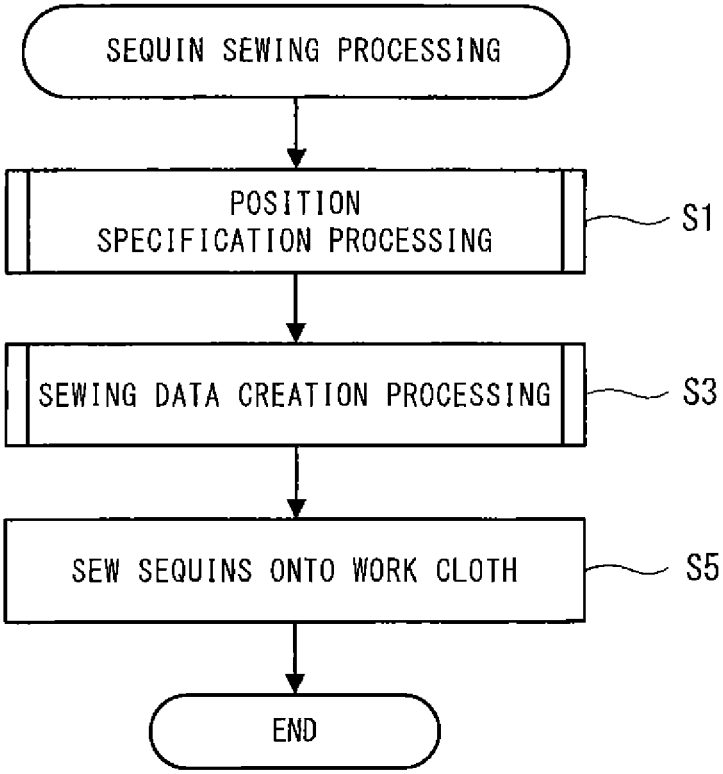
FIG. 10 is a flowchart that shows sequin sewing processing in the first embodiment.

After terminating the sewing data creation processing, the CPU 61, at Step S5 of the sequin sewing processing that is shown in FIG. 10, controls the sewing machine 1 such that the sequins 36 are sewn onto the work cloth 100 in ascending order of the needle drop point number m of the needle drop point N[m].

First Specific Example

Figure 14:
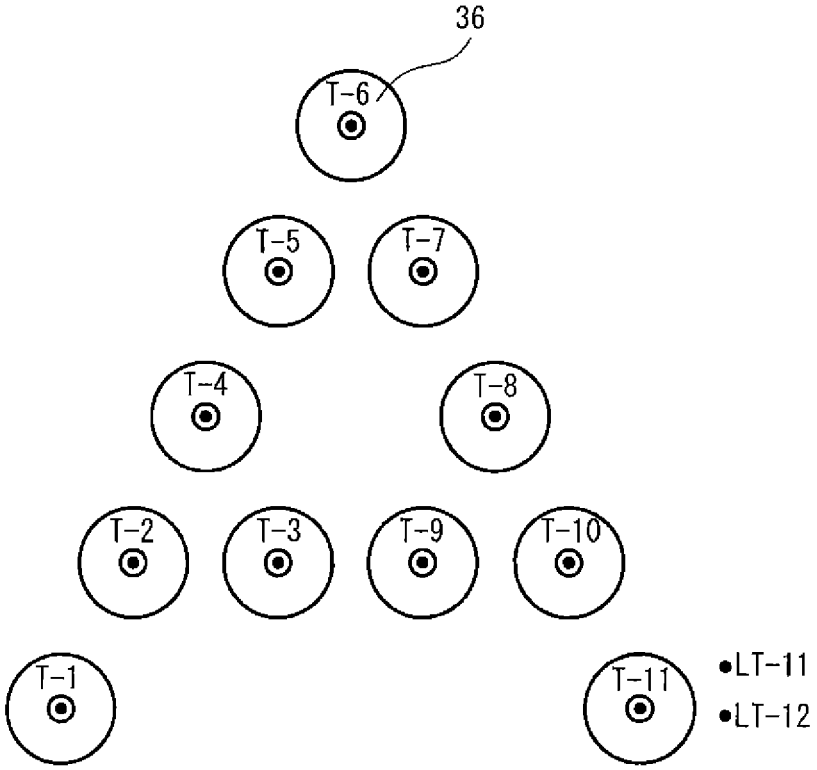
FIG. 14 is a top view that shows touch positions on the work cloth in a first specific example.
Figure 15:
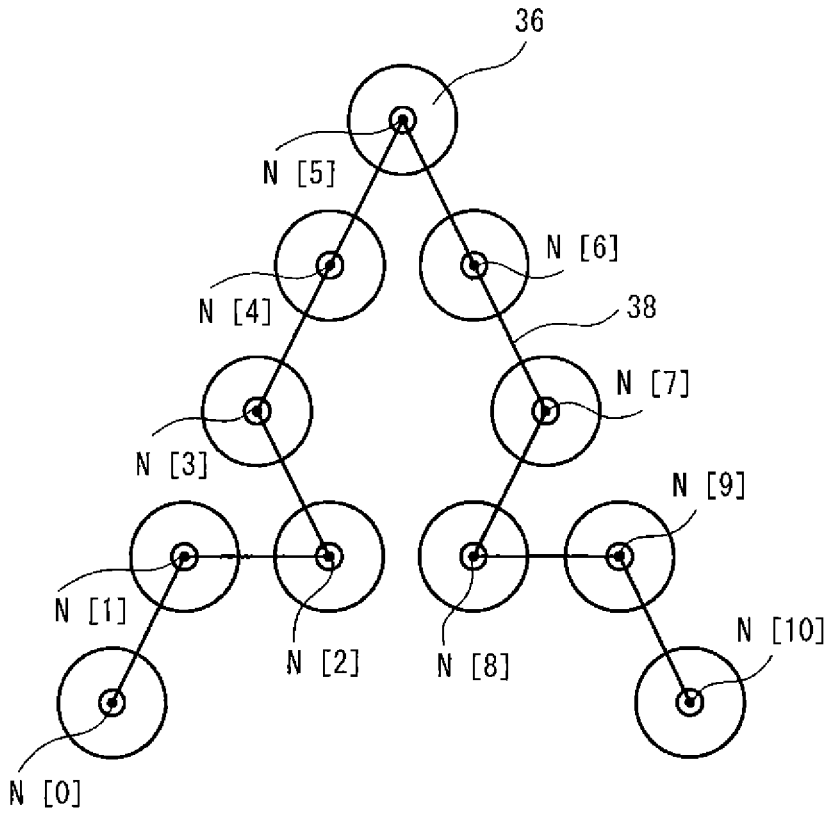
FIG. 15 is a top view that shows a state in which positions inside holes in sequins have been sewn in the first specific example.

A first specific example of sewing the sequins 36 onto the work cloth 100 will be explained with reference to FIGS. 14 and 15. In the first specific example, positions that are indicated by regular touch designated coordinates T-1 to T-11 and long touch designated coordinates LT-11, LT-11 are touched in that order, as shown in FIG. 14. In FIGS. 14 to 19, the work cloth 100 is omitted in order to facilitate the explanation.

The sequin sewing processing (refer to FIG. 10) for the first specific example will be explained. First, in the position specification processing (Step S1), the CPU 61, at Step S19, writes the regular touch designated coordinates T-1 to T-11, which are the designated coordinates Q1, to the center coordinates P[0] to P[10], respectively. At Step S35, the CPU 61 writes, to the total number of center points Cn, the value (11) of the index i1, which indicates the current number of center points, and writes, to the total number of radii Dn, the value (0) of the index i2, which indicates the current number of radii.

Next, in the sewing data creation processing (Step S3), the CPU 61, at Step S80, determines that the total number of radii Dn equals zero. Therefore, at Step S99, the CPU 61 writes the center coordinates P[0] to P[10] to the needle drop points N[0] to N[10], respectively.

Next, at Step S5, the sewing machine 1 sews the sequins 36 onto the work cloth 100 such that a thread 38 connects the needle drop points N[0] to N[10], which are positions inside the holes in the sequins 36, as shown in FIG. 15. After completing the processing at Step S5, the CPU 61 terminates the sequin sewing processing in the first specific example.

Second Specific Example

A second specific example, in which sewing is done at positions inside the holes in the sequins 36 and positions outside of the sequins 36, will be explained with reference to FIGS. 16 and 17. In the second specific example, positions that are indicated by long touch designated coordinates LT-1, regular touch designated coordinates T-2 to T-12, and long touch designated coordinates LT-13, LT-14 are touched in that order, as shown in FIG. 16.

The sequin sewing processing (refer to FIG. 10) for the second specific example will be explained. First, in the position specification processing (Step S1), the CPU 61, at Step S29, writes, to the radius size R[0], the distance between the designated coordinates Q1 for the long touch LT-1 and the designated coordinates Q2 for the regular touch T-2. The CPU 61 writes the value (0) of the index i1 to the radius changing position POS[0]. At Step S19, the CPU 61 writes the regular touch designated coordinates T-2 to T-12, which are the designated coordinates Q1, to the center coordinates P[0] to P[10], respectively. At Step S35, the CPU 61 writes the value (11) of the index i1 to the total number of center points Cn, and writes the value (1) of the index i2 to the total number of radii Dn.

Next, the sewing data creation processing (Step S3) will be explained. First, the processing for the first sequin 36 will be explained. At Step S89, the CPU 61 writes the center coordinates P[0] to the needle drop points N[0], N[2], N[4], N[6], as shown in FIG. 17. At Step S91, the CPU 61 writes, to the needle drop point N[1], the coordinates of the point of intersection between a line segment and a circumference C0, the line segment being formed by rotating a line segment that links the center coordinates P[0] and the center coordinates P[1] by 120 degrees counterclockwise around the center coordinates P[0], and the circumference C0 having the center of the circumference C0 at the center coordinates P[0] and having a radius that is the radius size R[0] plus the correction value a. A line segment that links the point of intersection and the position that is indicated by the center coordinates P[0] is defined as a line segment PP0. A line segment that links the position that is indicated by the center coordinates P[0] and the position that is indicated by the center coordinates P[1] is defined as a line segment PP1. At Step S93, the CPU 61 writes, to the needle drop point N[3], the coordinates of a point, on the circumference C0, at 120 degrees from the needle drop point N[1] within the range of an angle β (240 degrees) that is the larger of the angles between the line segment PP0 and the line segment PP1, the point being. At Step S95, the CPU 61 writes, to the needle drop points N[5], N[7], the coordinates of the point of intersection between the line segment PP1 and the circumference C0. Thereafter, the needle drop points N for the second and subsequent sequins 36 are set in the same manner. At Step S87, when the CPU 61 determines that the center point number j is not less than the total number of center points Cn, which is 11, the CPU 61 terminates the sewing data creation processing. In the sewing data creation processing, eighty-eight of the needle drop points N are set, which is eight times the total number of center points Cn (11).

Figure 17:
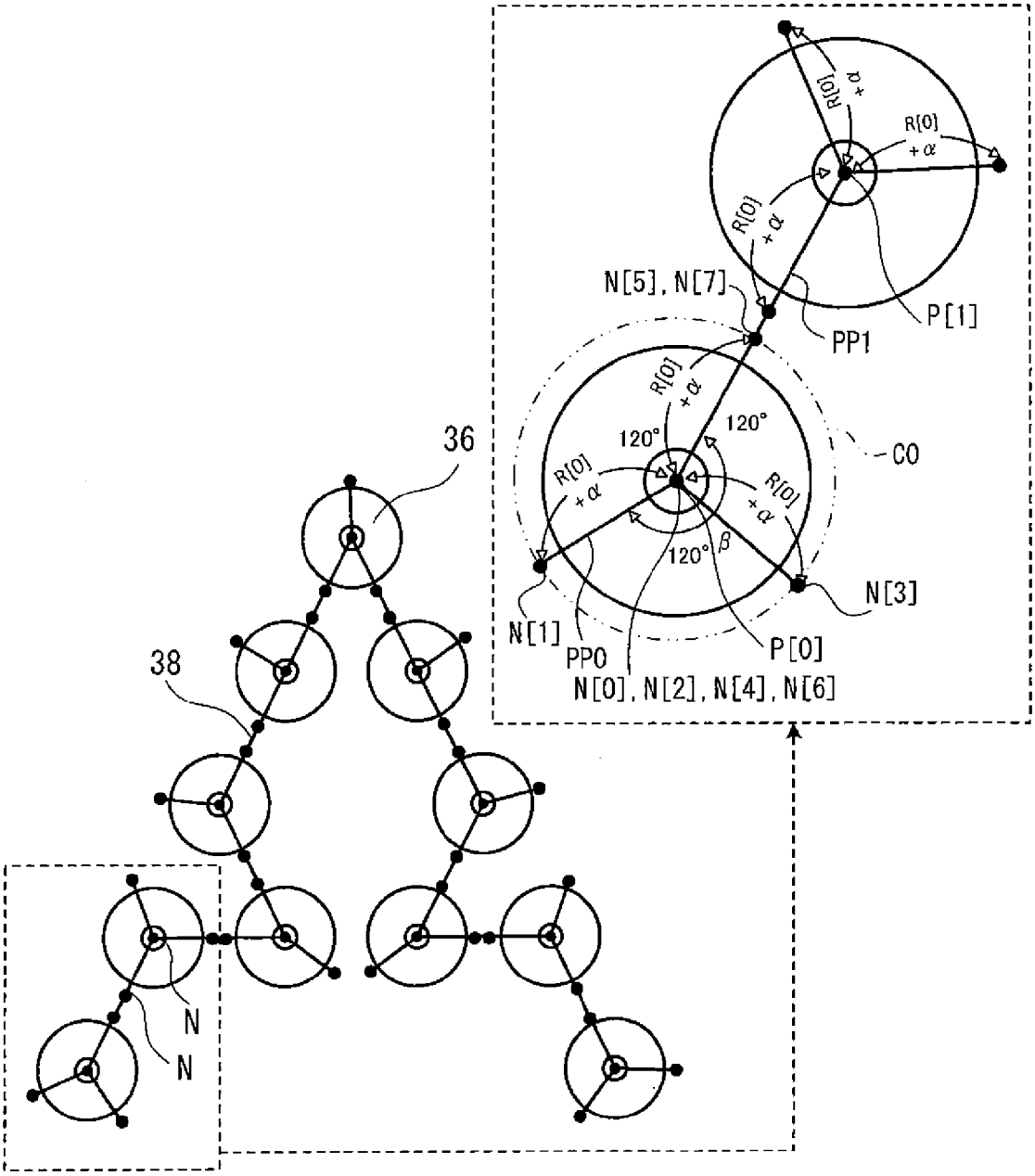
FIG. 17 is a top view that shows a state in which positions inside the holes in the sequins and positions outside the holes have been sewn in the second specific example.

Next, at Step S5, the sewing machine 1 sews the sequins 36 onto the work cloth 100 such that the thread 38 connects the needle drop points N that are in positions that are inside the holes in the individual sequins 36 and the needle drop points N that are in positions that are outside of the individual sequins 36, as shown in FIG. 17. After completing the processing at Step S5, the CPU 61 terminates the sequin sewing processing in the second specific example.

Third Specific Example

Figure 18:
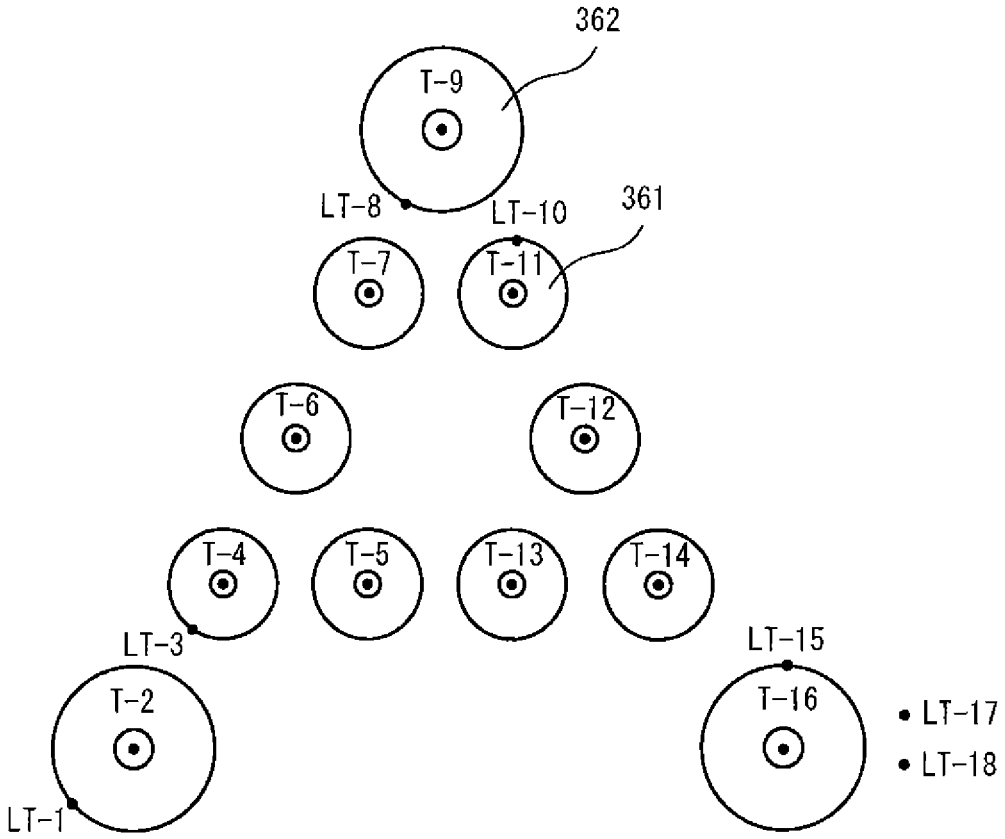
FIG. 18 is a top view that shows the touch positions on the work cloth in a third specific example.

A third specific example, in which sewing is done at positions inside the holes in sequins 361, 362, which have different outer radii, and at positions outside of the sequins 361, 362, will be explained with reference to FIGS. 18 and 19. In the third specific example, positions that are indicated by long touch designated coordinates LT-1, regular touch designated coordinates T-2, long touch designated coordinates LT-3, regular touch designated coordinates T-4 to T-7, long touch designated coordinates LT-8, regular touch designated coordinates T-9, long touch designated coordinates LT-10, regular touch designated coordinates T-11 to T-14, long touch designated coordinates LT-15, regular touch designated coordinates T-16, long touch designated coordinates LT-17, LT-18 are touched in that order, as shown in FIG. 18.

The sequin sewing processing (refer to FIG. 10) for the third specific example will be explained. First, in the position specification processing (Step S1), the CPU 61, at Step S19, writes the regular touch designated coordinates T-2, T-4 to T-7, T-9, T-11 to T-14, and T-16 to the center coordinates P[0] to P[10], respectively. At Step S29, the CPU 61 writes, to the radius sizes R[0] to R[4], the distance between the long touch designated coordinates LT-1 and the regular touch designated coordinates T-2, the distance between the long touch designated coordinates LT-3 and the regular touch designated coordinates T-4, the distance between the long touch designated coordinates LT-8 and the regular touch designated coordinates T-9, the distance between the long touch designated coordinates LT-10 and the regular touch designated coordinates T-11, and the distance between the long touch designated coordinates LT-15 and the regular touch designated coordinates T-16, in that order. The CPU 61 writes the values (0, 1, 5, 6, 10) of the index it to the radius changing positions POS[0] to POS[4], in that order. At Step S35, the CPU 61 writes the value (11) of the index i1 to the total number of center points Cn. The CPU 61 writes the value (5) of the index i2 to the total number of radii Dn.

Next, the sewing data creation processing (Step S3) will be explained. First, the processing for the first sequin, which is one of the sequins 362, will be explained. At Step S89, the CPU 61 writes the center coordinates P[0] to the needle drop points N[0], N[2], N[4], N[6], as shown in FIG. 19. At Step S91, the CPU 61 writes, to the needle drop point N[1], the coordinates of the point of intersection between a line segment and a circumference C0, the line segment being formed by rotating a line segment that links the center coordinates P[0] and the center coordinates P[1] by 120 degrees counterclockwise around the center coordinates P[0], and the circumference C0 having the center of the circumference C0 at the center coordinates P[0] and having a radius that is the radius size R[0] plus the correction value a. A line segment that links the point of intersection and the position that is indicated by the center coordinates P[0] is defined as a line segment PP0. A line segment that links the position that is indicated by the center coordinates P[0] and the position that is indicated by the center coordinates P[1] is defined as a line segment PP1. At Step S93, the CPU 61 writes, to the needle drop point N[3], the coordinates of a point, on the circumference C0, at 120 degrees from the needle drop point N[1] within the range of an angle β (240 degrees) that is the larger of the angles between the line segment PP0 and the line segment PP1. At Step S95, the CPU 61 writes, to the needle drop points N[5], N[7], the coordinates of the point of intersection between the line segment PP1 and the circumference C0.

Next, the processing for the second sequin, which is one of the sequins 361, will be explained. At Step S89, the CPU 61 writes the center coordinates P[1] to the needle drop points N[8], N[10], N[12], N[14]. At Step S91, the CPU 61 writes, to the needle drop point N[9], the coordinates of the point of intersection between the line segment PP1 and a circumference C1, which has the center of the circumference C1 at the center coordinates P[1] and has a radius that is the radius size R[1] plus the correction value a. At Step S93, the CPU 61 writes, to the needle drop point N[11], the coordinates of a point, on the circumference C1, at β/2 degrees from the needle drop point N[9] within the range of an angle 13 that is the larger of the angles between the line segment PP1 and a line segment PP2. The line segment PP2 is a line segment that links the position that is indicated by the center coordinates P[1] and the position that is indicated by the center coordinates P[2]. At Step S95, the CPU 61 writes, to the needle drop points N[13], N[15], the coordinates of the point of intersection between the line segment PP2 and the circumference C1. Thereafter, the needle drop points N for the third and subsequent sequins 361, 362 are set in the same manner. At Step S87, when the CPU 61 determines that the center point number j is not less than the total number of center points Cn, which is 11, the CPU 61 terminates the sewing data creation processing. In the sewing data creation processing, eighty-eight of the needle drop points N are set, which is eight times the total number of center points Cn (11).

Figure 19:
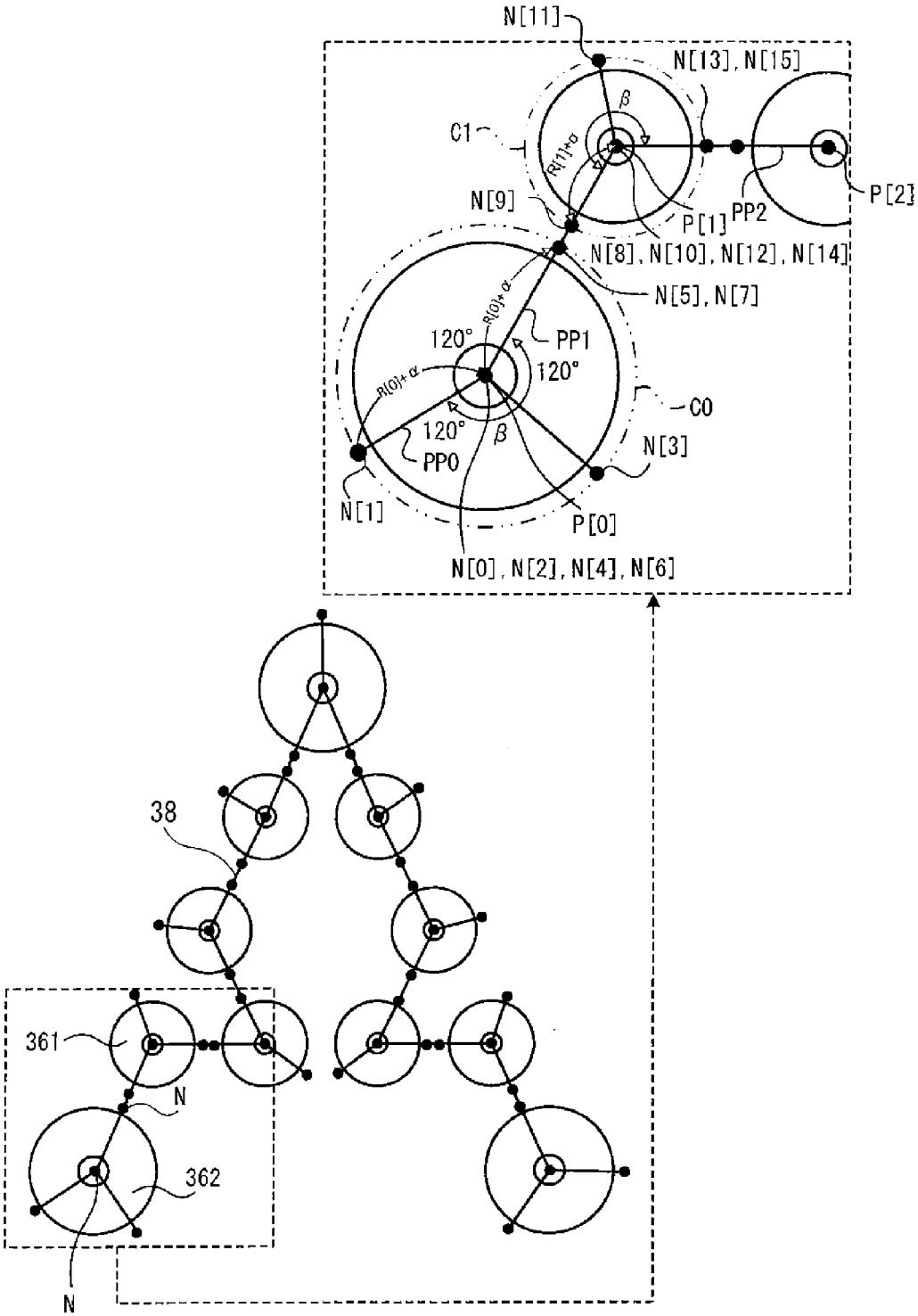
FIG. 19 is a top view that shows a state, in the third specific example, in which sewing has been performed at positions inside the holes in sequins that have different outer radii and at positions outside of the sequins.

At Step S5, the sewing machine 1 sews the sequins 361, 362 onto the work cloth 100 such that the thread 38 connects the needle drop points N that are in positions that are inside the holes in the individual sequins 361, 362 and the needle drop points N that are in positions that are outside of the individual sequins 361, 362, as shown in FIG. 19. After completing the processing at Step S5, the CPU 61 terminates the sequin sewing processing in the third specific example.

Figure 20:
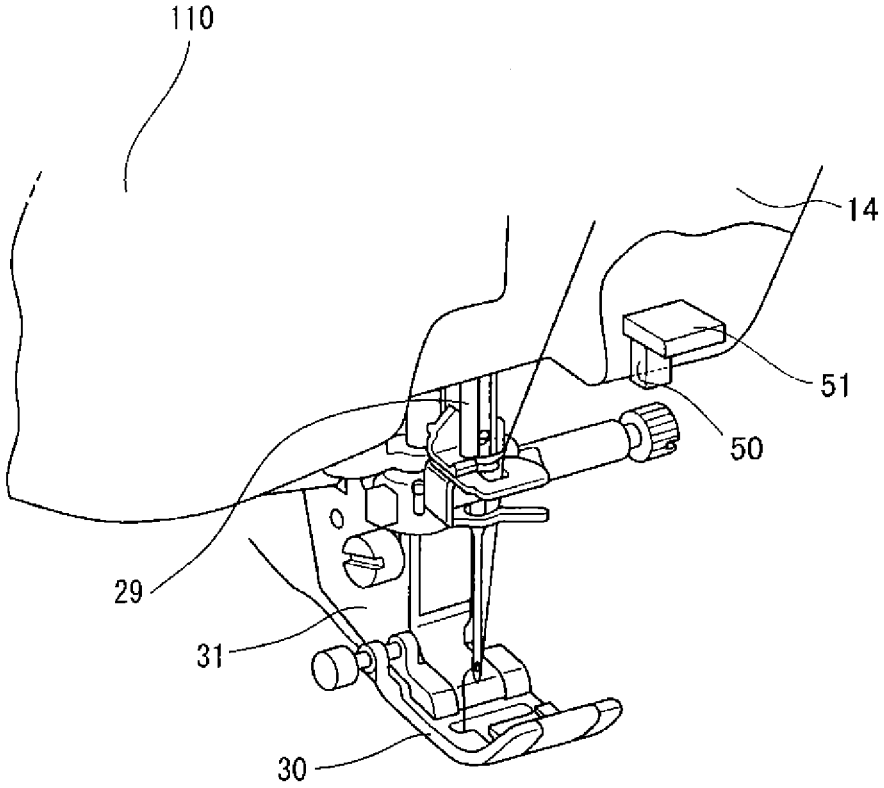
FIG. 20 is an enlarged oblique view of a head in a second embodiment.

The sewing machine 110 in a second embodiment The configuration of the sewing machine 110 in a second embodiment will be explained with reference to FIG. 20. As shown schematically in FIG. 20, the configuration of the sewing machine 110 in the second embodiment differs from the configuration of the sewing machine 1 in the first embodiment in that the sewing machine 110 includes an image sensor 50. For the elements of the sewing machine 110 that are the same as the elements of the sewing machine 1 in the first embodiment, the same reference numerals are used and explanations are omitted.

The image sensor 50 of the sewing machine 110 will be explained with reference to FIG. 20. The image sensor 50 is mounted in the interior of the head 14. A support frame 51 is attached to a machine casing of the sewing machine 110. The image sensor 50 is affixed to the support frame 51. The image sensor 50 may be, for example, a known CMOS image sensor that includes a CMOS sensor and a control circuit. The image sensor 50 may be a known CCD sensor. The image sensor 50 can capture an image of the embroidery frame 35 from above. The image sensor 50 converts incident light into an electrical signal, which the image sensor 50 then outputs. The image of the embroidery frame 35 that is captured may include the sequins 36 that have been disposed on the work cloth 100. The image capture range of the image sensor 50 is defined as the range in which an image can be captured of the area inside the inner frame 112 of the embroidery frame 35.

Sequin Sewing Processing in the Second Embodiment

Figure 21:
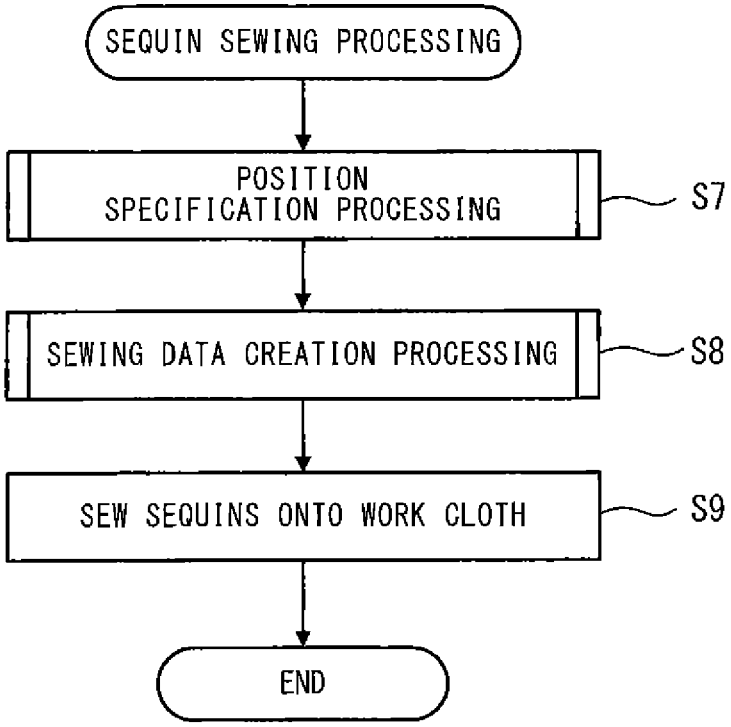
FIG. 21 is a flowchart that shows sequin sewing processing in the second embodiment.

The sequin sewing processing in the second embodiment will be explained with reference to FIG. 21. The sequin sewing processing in the second embodiment is performed by the CPU 61 in accordance with a sewing program that is stored in the ROM 62 and is different from the sewing program 500 in the first embodiment. The CPU 61 executes the program that is shown in FIG. 21 in a case where the sequin sewing mode has been selected via the touch panel 26. Each of the steps that are shown in the flowchart of the sequin sewing processing indicates processing by the CPU 61.

Figure 22:
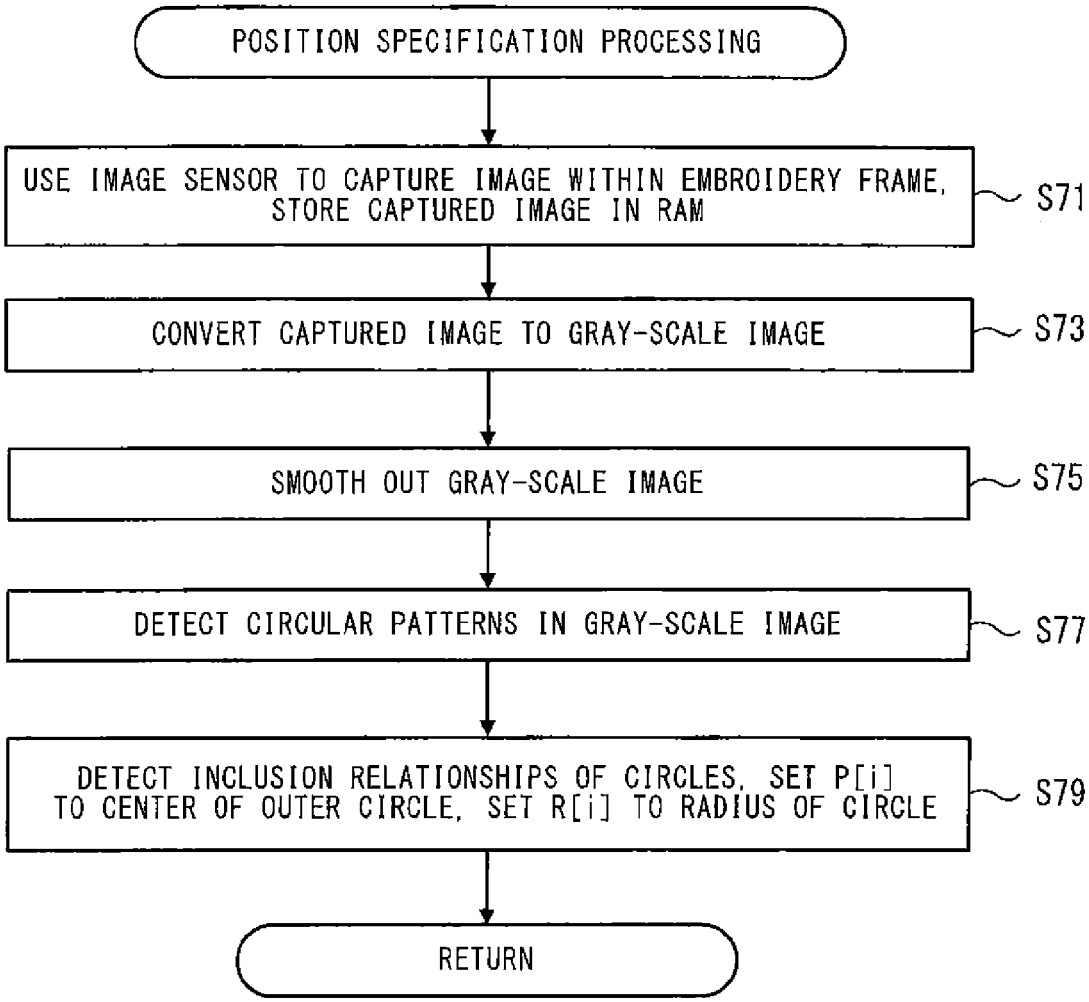
FIG. 22 is a flowchart that shows details of position specification processing that is performed in the sequin sewing processing that is shown in FIG. 21.
Figure 23:
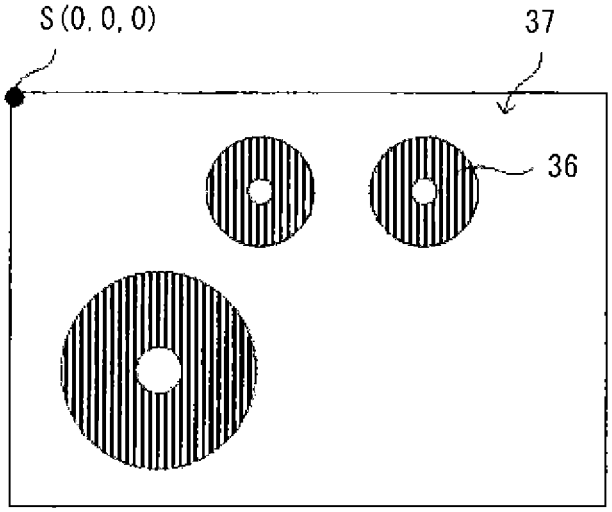
FIG. 23 is an explanatory figure that shows image data in the position specification processing.

At Step S7, the CPU 61 performs the position specification processing. Specifically, based on a captured image 37 that has been captured by the image sensor 50 and includes the sequins 36, as shown in FIG. 23, the CPU 61 specifies the outer sizes of the sequins 36 that have been disposed on the work cloth 100 and positions inside the holes in the sequins 36. The area in the captured image 37 and the area on the work cloth 100 are stored in the RAM 63 in association with one another. For example, a point in the left rear corner of the captured image 37 is set such that the point in the left rear corner of the captured image 37 is congruent with the origin point S (0, 0, 0) of the embroidery frame 35 that is shown in FIG. 9. Therefore, a position on the work cloth 100 can be specified based on a position in the captured image 37. Furthermore, a correspondence relationship between a distance in the captured image 37 and an actual distance on the work cloth 100 can be set in advance. Therefore, the outer radius of an actual circular sequin 36 can be specified based on an image of the sequin 36 in the captured image 37. A position inside the hole in a sequin 36 may be, for example, the center position of the hole in the sequin 36. The outer size of the sequin 36 may be indicated by the radius of the outer circle of the sequin 36, for example. The position specification processing will be described in detail below, with reference to FIGS. 22 to 26.

At Step S8, the CPU 61 performs the sewing data creation processing. Specifically, the CPU 61 creates the sewing data EB based on the position inside the hole in a sequin 36 that was specified at Step S7. The sewing data creation processing that is performed at Step S8 is processing that is the same as the above-described sewing data creation processing (refer to FIG. 13) that is performed at Step S3.

At Step S9, the CPU 61 controls the sewing machine 110 such that the sewing machine 110 sews the sequins 36 onto the work cloth 100 based on the sewing data EB that were created at Step S8. After completing the processing at Step S9, the CPU 61 terminates the sequin sewing processing.

Position Specification Processing in the Second Embodiment

The position specification processing in the second embodiment will be explained in detail with reference to FIG. 22. When the CPU 61 starts the position specification processing, the CPU 61 advances the processing to Step S71.

At Step S71, the CPU 61 performs control such that the image sensor 50 captures an image within the embroidery frame 35, as shown in FIG. 23. The CPU 61 stores, in the RAM 63, the image data for the captured image 37 that has been captured by the image sensor 50.

At Step S73, the CPU 61 converts the image data for the captured image 37 into gray-scale image data.

Figure 24:
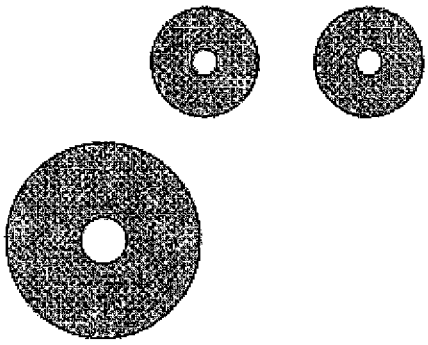
FIG. 24 is an explanatory figure that shows image data in the position specification processing.

At Step S75, the CPU 61 smooths out the gray-scale image data, as shown in FIG. 24, in order to prevent false detection.

Figure 25:
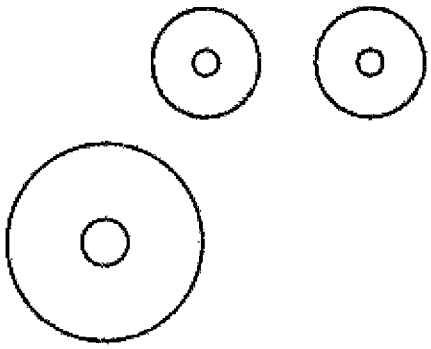
FIG. 25 is an explanatory figure that shows image data in the position specification processing.

At Step S77, the CPU 61 uses a known Hough transformation to detect circular patterns in the gray-scale image data, as shown in FIG. 25. For example, the CPU 61 may detect the circular patterns by using an image processing library such as OpenCV or the like.

Figure 26:
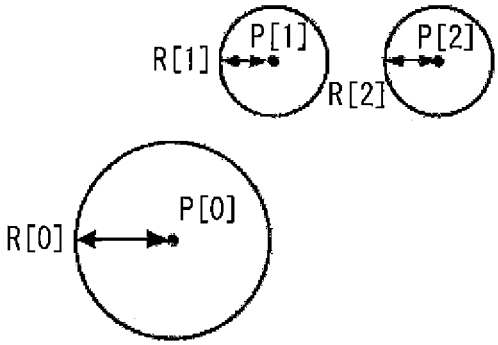
FIG. 26 is an explanatory figure that shows image data in the position specification processing.

At Step S79, the CPU 61 detects inclusion relationships among the circles, as shown in FIG. 26. The CPU 61 writes the coordinates of the center of each of the outer circles to the center coordinates P[i1] and writes the radius of each of the outer circles to the radius size R[i2]. The CPU 61 detects the center coordinates P[i1] and the radius size R[i2] based on the circular patterns. The CPU 61 computes the number of different sets of the center coordinates P[i1] and computes the total number of center points Cn. The CPU 61 computes the number of different radius sizes R[i2] and computes the total number of radii Dn. The CPU 61 also stores the center coordinates P[i1] and the radius sizes R[i2] in the RAM 63 in the order in which the CPU 61 read the circular patterns. The CPU 61 stores the radius changing positions POS [i2] in the RAM 63 in the order in which the CPU 61 read the circular patterns. For example, based on the circular patterns, the CPU 61 may write the positions of the center points of three of the sequins 36 as the center coordinates P[0], P[1], P[2] in the RAM 63, and write the radius sizes of those sequins 36 as the radius sizes R[0], R[1], R[2] in the RAM 63. After completing the processing at Step S79, the CPU 61 terminates the position specification processing. After terminating the position specification processing, the CPU 61 returns to the sequin sewing processing that is shown in FIG. 21 and advances the processing to the sewing data creation processing (Step S9).

Effects of the Embodiments

In the first embodiment, the sewing machine 1 can create the sewing data EB at Step S3 based on the positions inside the holes of the sequins 36, which are specified at Step S1 in FIG. 10. In the second embodiment, the sewing machine 110 can create the sewing data EB at Step S8 based on the positions inside the holes of the sequins 36, which are specified at Step S7 in FIG. 21. The user, after checking the arrangement of the sequins 36 on the work cloth 100, is thus able to perform the sewing in accordance with the arrangement of the sequins 36.

Figure 11:
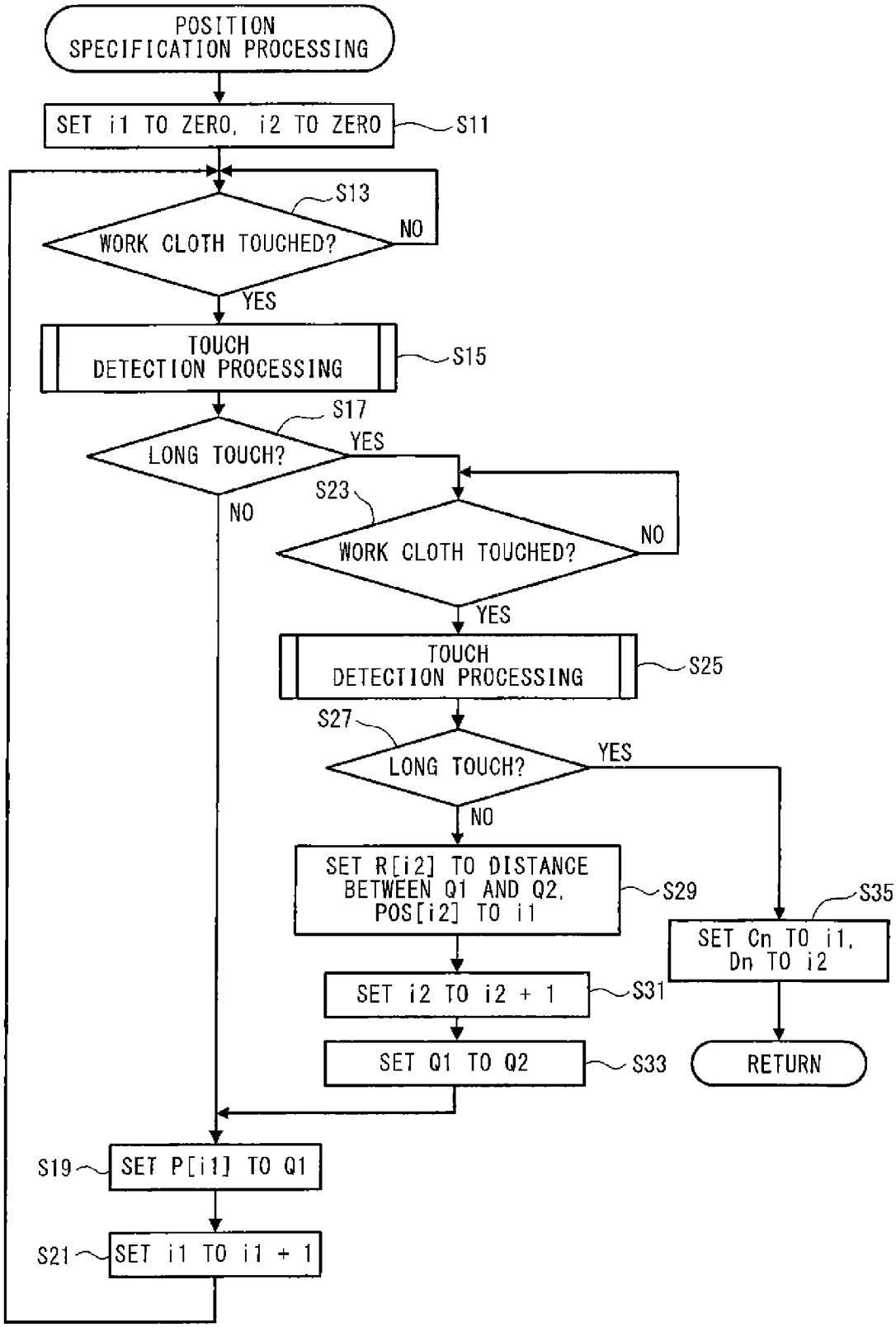
FIG. 11 is a flowchart that shows position specification processing that is performed in the sequin sewing processing that is shown in FIG. 10.
Figure 12:
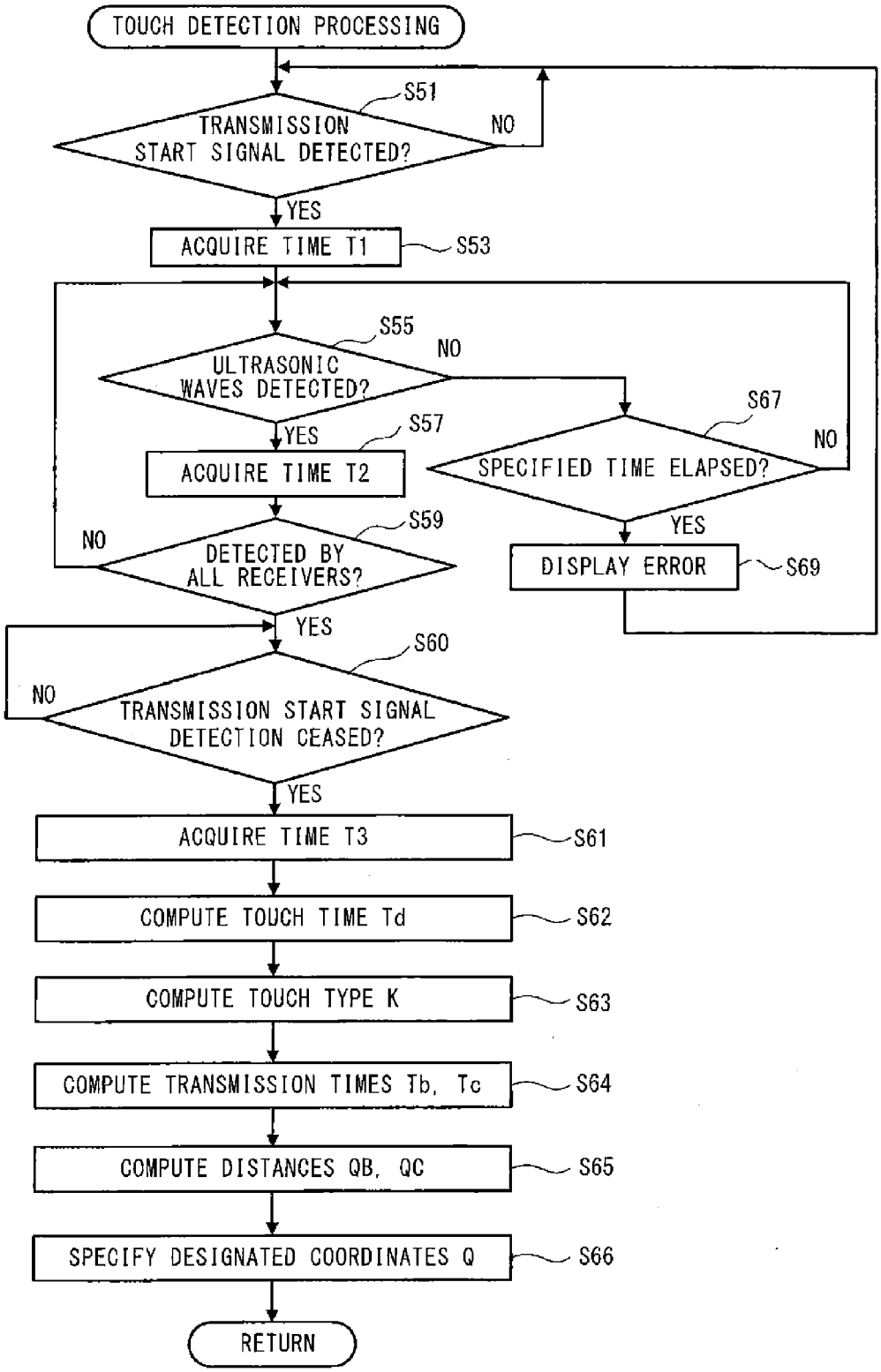
FIG. 12 is a flowchart that shows touch detection processing that is performed in the position specification processing that is shown in FIG. 11.
Figure 13:
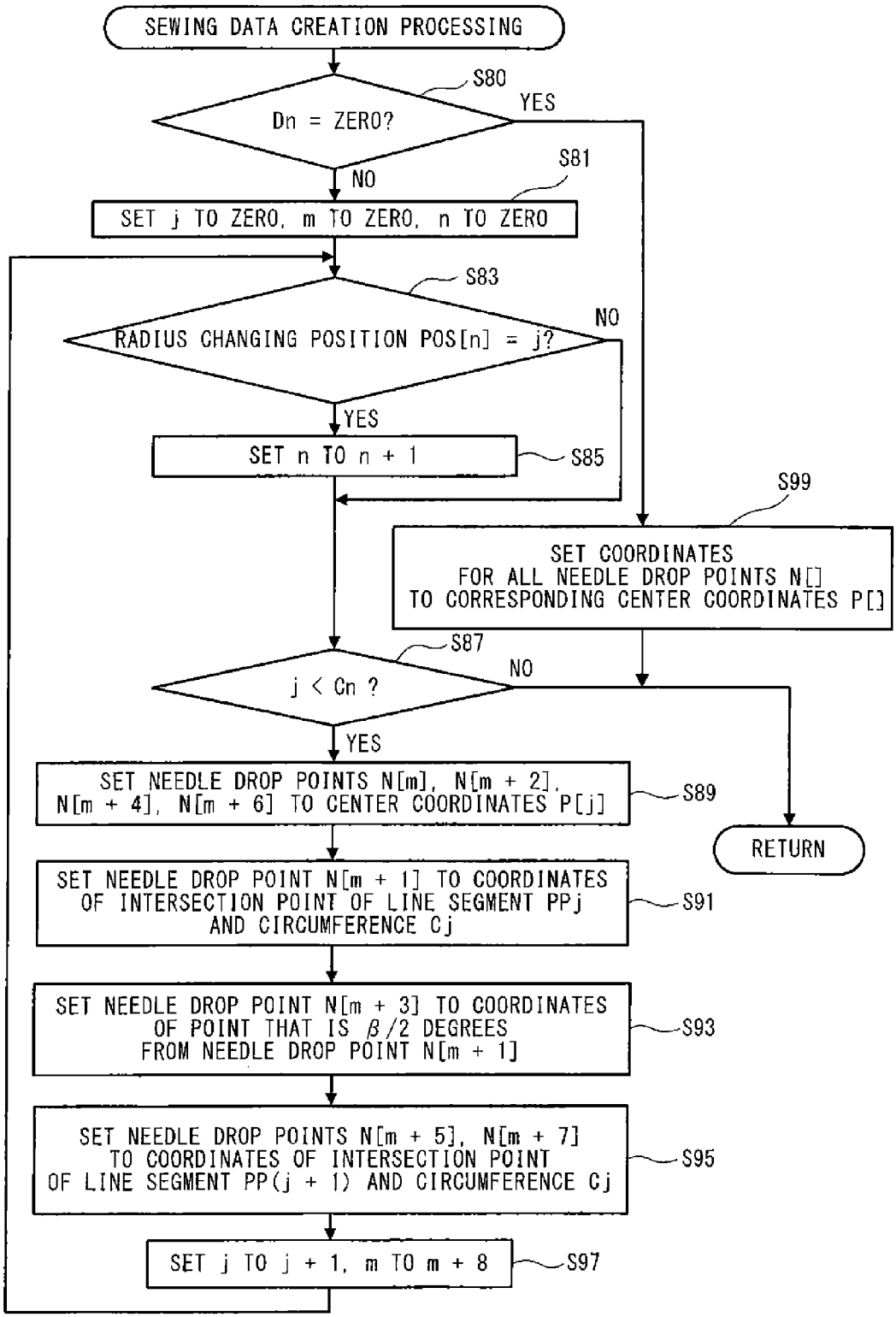
FIG. 13 is a flowchart that shows sewing data creation processing that is performed in the sequin sewing processing that is shown in FIG. 10.

In the first embodiment, the sewing machine 1, at Steps S91, S93, and S95 in FIG. 13, can specify the positions that are outside of the sequins 36, based on the sizes of the outer radii of the sequins 36, which are specified at Step S29 in FIG. 11. In the second embodiment, the sewing machine 110, at Steps S91, S93, and S95 in FIG. 13, can specify the positions that are outside of the sequins 36, based on the sizes of the outer radii of the sequins 36, which are specified at Step S79 in FIG. 22. The sewing machines 1, 110 can thus specify the positions that are outside of the sequins 36. Then at Step S5 in FIG. 10 and at Step S9 in FIG. 21, the sequins 36 can be sewn onto the work cloth 100 such that the thread 38 connects the positions inside the holes of the sequins 36 and the positions that are outside of the sequins 36. The user is thus able to designate the sewing positions for the sequins 36 freely, without being limited to the positions inside the holes of the sequins 36.

In the first embodiment, the sewing machine 1 is able to specify the positions inside the holes of the sequins 36 by detecting the touches of the ultrasonic pen 91 at Steps S15 and S25 in FIG. 11. The user, after checking the positions inside the holes of the sequins 36 as the needle drop points for sewing the sequins 36, is thus able to designate the sewing positions as desired.

In the first embodiment, the sewing machine 1 can set the sewing order for the sequins 36 at Step S3, based on order of the touches by the ultrasonic pen 91 at Step S1 in FIG. 10. The user is therefore able to specify both the needle drop points and the sewing order at the same time.

In the first embodiment, at Step S1 in FIG. 10, the sewing machine 1 can specify the outer sizes of the sequins 36 based on the distances between the designated coordinates Q1 that are specified by long touches of the ultrasonic pen 91 and the designated coordinates Q2 that are designated by regular touches of the ultrasonic pen 91. The user, after checking the outer shapes of the sequins 36, is thus able to designate the outer sizes of the sequins 36.

In the second embodiment, the sewing machine 110 can specify the positions inside the holes of the sequins 36 based on the captured image 37 that has been captured by the image sensor 50. The user is thus able to designate, all at once, the needle drop points that are located at the positions inside the holes of all the sequins 36 that are shown in the captured image 37 from the image sensor 50, without having to designate the needle drop points that are located at the positions inside the holes of the sequins 36 one at a time.

In the second embodiment, the sewing machine 110 can specify the outer sizes of the sequins 36 based on the captured image 37 that has been captured by the image sensor 50. The user is thus able to designate, all at once, the needle drop points that are located at the positions that are outside of all the sequins 36, based on the outer sizes of the sequins 36 that are shown in the captured image 37 from the image sensor 50, without having to designate the needle drop points that are located at the positions that are outside of the sequins 36 one at a time.

Modified Examples

The present disclosure is not limited to the embodiments that have been described above, and various types of embodiments can be implemented within the scope of the present disclosure.

In the first specific example, the needle drop points N[m] are set only to the positions inside the holes of the sequins 36. However, it is also acceptable for the needle drop points not to be set to the positions inside the holes of the sequins 36. For example, needle drop points N[0], N[1], N[2], N[3] may be set, in that order, to four positions that are outside of the sequins 36 and that are positioned at 90-degree intervals around a circumference whose center is at the center coordinates P[0]. Sewing may be performed such that the thread 38 connects the opposing pairs of the needle drop points N[0], N[2] and the needle drop points N[1], N[3].

In the second specific example and the third specific example, the needle drop points are set at three points that are outside of each one of the sequins 36, in addition to the position inside the hole of the sequin 36. However, the setting of the needle drop points is not limited to three points outside of each one of the sequins 36, and the needle drop points may be set at any one of one, two, and more than three points outside of each one of the sequins 36.

In the first to the third specific examples, at Step S5 in FIG. 10, the sewing machine 1 may use a known method to sew stop stitches at the first needle drop point N and the last needle drop point N. For example, Japanese Laid-Open Patent Publication No. H11-239685 discloses a method of sewing stop stitches, the relevant portions of which are incorporated by reference. By sewing the stop stitches, the sewing machine 1 makes the sequins 36 resistant to falling off of the work cloth 100.

In the first embodiment, the radius size R[i2] is designated by the performing of a regular touch after a long touch. Furthermore, performing two long touches in succession causes the CPU 61 to terminate the position specification processing. However, the combinations of touches for making various types of designations, such as a radius size designation, the terminating of the position specification processing, and the like, can be modified as desired.

In the first embodiment, the radius size R[i2] is designated by touches of the ultrasonic pen 91 in order to specify a position outside of the sequin 36. However, the position outside of the sequin 36 may be specified directly by a touch of the ultrasonic pen 91, instead of by the radius size R[i2]. The radius size R[i2] may be designated by a touch on the touch panel 26, instead of by the touches of the ultrasonic pen 91.

In the first embodiment, instead of the ultrasonic pen 91, the sewing machine 1 may be provided with an ultrasonic pen that outputs an electromagnetic wave signal. In that case, the sewing machine 1 may detect the electromagnetic wave signal, and based on the time when the electromagnetic wave signal was detected, may specify the time that the ultrasonic waves were transmitted. In that case, it would not be necessary for the sewing machine 1 to be provided with the cable 912 via which the transmission start signal is output.

In the first embodiment, the sewing machine 1 may include more than two receivers and may specify the designated coordinates based only on the times when the ultrasonic waves were detected by the individual receivers. In that case, the receivers may be provided in any part of the sewing machine 1. For example, the receivers may be provided on the front face of the pillar 12 or on the bottom face of the arm 13.

In the first embodiment and the second embodiment, the sewing machine 1 was explained as an example of a sewing machine for home use. However, the present disclosure is not limited to a sewing machine for home use, and may be applied to a commercial sewing machine and a multi-needle sewing machine.

In the first embodiment and the second embodiment, the outer size of the sequin 36 is indicated by the outer radius size R[i2] of the sequin 36. However, other information that indicates the outer size of the sequin 36, such as the diameter of the sequin 36, may also be used.

In the first embodiment and the second embodiment, the processing that specifies the position inside the hole in the sequin 36, the processing that creates the sewing data EB, the processing that specifies the outer size of the sequin 36, the processing that specifies the position outside of the sequin 36, and the processing that sets the sewing order for the sequins 36 are performed by software that the CPU 61 executes. However, all of the processing may be implemented in the form of hardware.

The sewing program may be recorded on a computer-readable medium such as a hard disk, a flexible disk, a CD-ROM, a DVD, or the like, and may be executed by being read from the computer-readable medium by a computer. The sewing program may be in the form of a transmission medium that can be distributed via a network such as the Internet or the like.

At least one of the position specification processing and the sewing data creation processing may be performed by a device other than the sewing machines 1, 110, such as a personal computer, a dedicated machine, or the like. Furthermore, in a case where at least one of the position specification processing and the sewing data creation processing is performed by a device other than the sewing machines 1, 110, the sewing machines 1, 110 and the device other than the sewing machines 1, 110 may be connected either by wire or wirelessly, and data may be transmitted and received in between the sewing machines 1, 110 and the device other than the sewing machines 1, 110.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a sewing portion configured to perform sewing on a work cloth;

a processor; and a memory configured to store computer-readable instructions that cause the processor to perform processes including:

specifying an inside position corresponding to a position inside a hole in at least one sequin that has been disposed on the work cloth in advance;

creating sewing data based on the inside position that has been specified, the sewing data including at least needle drop point data and being data for sewing the at least one sequin onto the work cloth, and the needle drop point data indicating a point where a sewing needle is to pierce the work cloth;

causing the sewing portion to sew the at least one sequin onto the work cloth, based on the created sewing data;

specifying an outer size corresponding to a size of an outer shape of the at least one sequin; and specifying an outside position based on the specified outer size, the specified outside position being a position that is outside the outer shape of the at least one sequin, wherein the creation of the sewing data includes sewing the at least one sequin onto the work cloth by using a thread to connect the specified inside position and the specified outside position.

2. The sewing machine according to claim 1, further comprising a position designating portion that includes:

a designating portion;

a transmitting portion configured to transmit ultrasonic waves when the designating portion is pressed against the work cloth; and a detecting portion configured to detect the ultrasonic waves that are transmitted from the transmitting portion, wherein the specification of the inside position includes specifying the inside position based on at least one time when the detecting portion has detected the ultrasonic waves that were transmitted from the transmitting portion when the designating portion was pressed at the inside position.

3. The sewing machine according to claim 2, wherein the creating of the sewing data includes:

setting a sewing order for a plurality of sequins, based on a plurality of times when the detecting portion has detected ultrasonic waves that were transmitted from the transmitting portion when the designating portion was pressed at inside positions inside holes of the plurality of sequins; and creating the sewing data in accordance with the sewing order that has been set for the plurality of sequins.

4. The sewing machine according to claim 2, wherein the specification of the outer size includes specifying the outer size based on a distance between a first position and a second position, the first position being a position where the designating portion has been pressed, and the second position being a position where the designating portion has been pressed after being pressed at the first position.

5. The sewing machine according to claim 1, further comprising:

an image capture portion configured to capture an image that includes the at least one sequin that has been disposed on the work cloth, wherein the specification of the inside position includes specifying the inside position based on the image that has been captured by the image capture portion.

6. The sewing machine according to claim 5, further comprising:

the specification of the outer size includes specifying the outer size based on the image that has been captured by the image capture portion.

7. An apparatus comprising:

a processor; and a memory configured to store computer-readable instructions that cause the processor to perform processes including:

specifying an inside position corresponding to a position inside a hole in at least one sequin that has been disposed on a work cloth in advance;

creating sewing data based on the inside position that has been specified, the sewing data including at least needle drop point data and being data for sewing the at least one sequin onto the work cloth, and the needle drop point data indicating a point where a sewing needle is to pierce the work cloth;

specifying an outer size corresponding to a size of an outer shape of the at least one sequin; and specifying an outside position based on the specified outer size, the specified outside position being a position that is outside the outer shape of the at least one sequin, wherein the creation of the sewing data includes sewing the at least one sequin onto the work cloth by using a thread to connect the specified inside position and the specified outside position.

8. The apparatus according to claim 7, wherein the specification of the inside position includes specifying the inside position based on at least one time when ultrasonic waves have been detected, the ultrasonic waves being transmitted from a transmitting portion when a designating portion was pressed at the inside position, the transmitting portion being configured to transmit ultrasonic waves when the designating portion is pressed against the work cloth.

9. The apparatus according to claim 8, wherein the creating of the sewing data includes:

setting a sewing order for a plurality of sequins, based on a plurality of times when ultrasonic waves has been detected, the ultrasonic waves being transmitted from the transmitting portion when the designating portion was pressed at inside positions inside holes of the plurality of sequins; and creating the sewing data in accordance with the sewing order that has been set for the plurality of sequins.

10. The apparatus according to claim 8, wherein the specification of the outer size includes specifying the outer size based on a distance between a first position and a second position, the first position being a position where the designating portion has been pressed, and the second position being a position where the designating portion has been pressed after being pressed at the first position.

11. The apparatus according to claim 7, wherein the specification of the inside position includes specifying the inside position based on an image that has been captured by an image capture portion, the image including the at least one sequin that has been disposed on the work cloth, and the image capture portion being configured to capture the image.

12. The apparatus to claim 11, wherein the specification of the outer size includes specifying the outer size based on the image that has been captured by the image capture portion.

13. A non-transitory computer-readable medium storing computer-readable instructions that, when executed by a processor of an apparatus, instruct the processor to perform processes comprising:

specifying an inside position corresponding to a position inside a hole in at least one sequin that has been disposed on a work cloth in advance;

creating sewing data based on the inside position that has been specified, the sewing data including at least needle drop point data and being data for sewing the at least one sequin onto the work cloth, and the needle drop point data indicating a point where a sewing needle is to pierce the work cloth;

specifying an outer size corresponding to a size of an outer shape of the at least one sequin;

specifying an outside position based on the specified outer size, the specified outside position being a position that is outside the outer shape of the at least one sequin; and the creation of the sewing data includes sewing the at least one sequin onto the work cloth by using a thread to connect the specified inside position and the specified outside position.

14. The non-transitory computer-readable medium according to claim 13, wherein the specification of the inside position includes specifying the inside position based on at least one time when ultrasonic waves have been detected, the ultrasonic waves being transmitted from a transmitting portion when a designating portion was pressed at the inside position, the transmitting portion being configured to transmit ultrasonic waves when the designating portion is pressed against the work cloth.

15. The non-transitory computer-readable medium according to claim 14, wherein the creating of the sewing data includes:

setting a sewing order for a plurality of sequins, based on a plurality of times when ultrasonic waves has been detected, the ultrasonic waves being transmitted from the transmitting portion when the designating portion was pressed at inside positions inside holes of the plurality of sequins; and creating the sewing data in accordance with the sewing order that has been set for the plurality of sequins.

16. The non-transitory computer-readable medium according to claim 14, wherein the specification of the outer size includes specifying the outer size based on a distance between a first position and a second position, the first position being a position where the designating portion has been pressed, and the second position being a position where the designating portion has been pressed after being pressed at the first position.

17. The non-transitory computer-readable medium according to claim 13, wherein the specification of the inside position includes specifying the inside position based on an image that has been captured by an image capture portion, the image including the at least one sequin that has been disposed on the work cloth, and the image capture portion being configured to capture the image, and the specification of the outer size includes specifying the outer size based on the image that has been captured by the image capture portion.

* * * * *